US010401060B2

(12) United States Patent
Tsuji et al.

(10) Patent No.: US 10,401,060 B2
(45) Date of Patent: Sep. 3, 2019

(54) CONDITIONER DETERMINING A CLOSED CONDITION OF AN EXPANSION VALVE

(71) Applicant: DAIKIN INDUSTRIES, LTD., Osaka-shi, Osaka (JP)

(72) Inventors: Yoshiyuki Tsuji, Sakai (JP); Yasushi Hori, Sakai (JP); Mariko Takakura, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 162 days.

(21) Appl. No.: 15/535,691

(22) PCT Filed: Dec. 8, 2015

(86) PCT No.: PCT/JP2015/084431

§ 371 (c)(1),
(2) Date: Jun. 13, 2017

(87) PCT Pub. No.: WO2016/098645

PCT Pub. Date: Jun. 23, 2016

(65) Prior Publication Data

US 2018/0356133 A1 Dec. 13, 2018

(30) Foreign Application Priority Data

Dec. 15, 2014 (JP) ..... 2014-253258

(51) Int. Cl.
*F25B 13/00* (2006.01)
*F25B 49/02* (2006.01)
*F24F 11/89* (2018.01)

(52) U.S. Cl.
CPC ..... *F25B 13/00* (2013.01); *F24F 11/89* (2018.01); *F25B 49/02* (2013.01); *F25B 49/022* (2013.01);
(Continued)

(58) Field of Classification Search
CPC ... F24F 11/89; F25B 13/00; F25B 2313/0233; F25B 2313/0314; F25B 2600/21;
(Continued)

(56) References Cited

U.S. PATENT DOCUMENTS 5,005,370 A * 4/1991 Tanaka ..... F25B 41/062 62/211
2005/0034473 A1* 2/2005 Casar ..... B60H 1/00899 62/324.1
(Continued)

FOREIGN PATENT DOCUMENTS

JP 2002-71188 A 3/2002
JP 2005-30679 A 2/2005
(Continued)

OTHER PUBLICATIONS

International Preliminary Report of corresponding PCT Application No. PCT/JP2015/084431 dated Jun. 29, 2017.
(Continued)

*Primary Examiner* — Henry T Crenshaw
(74) *Attorney, Agent, or Firm* — Global IP Counselors, LLP

(57) ABSTRACT

In an air conditioning apparatus, an expansion valve is determined to be in a fully closed state when a refrigerant temperature in an outlet of an indoor heat exchanger and a refrigerant temperature in an inlet or an intermediate part of the indoor heat exchanger satisfy a closed-valve condition. The temperature in the outlet is detected by a gas-side temperature sensor. The temperature in the inlet or the intermediate part is detected by a liquid-side temperature sensor. The closed-valve condition is in relation to a refrigerant evaporation temperature obtained by converting a refrigerant pressure in an intake side of a compressor to a refrigerant saturation temperature, and in relation to an air temperature of an air-conditioned space cooled by the indoor
(Continued)

heat exchanger. The pressure in the intake side is detected by an intake pressure sensor. The air temperature is detected by an indoor temperature sensor.

15 Claims, 4 Drawing Sheets

(52) U.S. Cl.
CPC ..... *F25B 2313/0233* (2013.01); *F25B 2313/0314* (2013.01); *F25B 2600/21* (2013.01); *F25B 2600/2513* (2013.01); *F25B 2700/1933* (2013.01); *F25B 2700/21174* (2013.01); *F25B 2700/21175* (2013.01)

(58) Field of Classification Search
CPC ..... F25B 2600/2513; F25B 2700/1933; F25B 2700/21174; F25B 2700/21175; F25B 49/02; F25B 49/022
See application file for complete search history.

(56) References Cited

U.S. PATENT DOCUMENTS

2006/0048539 A1* 3/2006 Takechi ..... F25B 13/00 62/513
2009/0013700 A1* 1/2009 Unezaki ..... F25B 9/008 62/77
2010/0174412 A1* 7/2010 Kwon ..... F25B 49/005 700/275
2011/0308267 A1* 12/2011 Tamaki ..... F25B 45/00 62/222
2013/0019617 A1* 1/2013 Hegar ..... F25B 47/022 62/81
2015/0068237 A1* 3/2015 Haikawa ..... F25B 1/005 62/207
2015/0168038 A1* 6/2015 Baltus ..... B01D 53/265 62/115

FOREIGN PATENT DOCUMENTS

JP 4762797 B2 6/2011
JP 2014-66424 A 4/2014

OTHER PUBLICATIONS

International Search Report of corresponding PCT Application No. PCT/JP2015/084431 dated Feb. 16, 2016.
European Search Report of corresponding EP Application No. 15 86 9850.6 dated Nov. 29, 2017.

* cited by examiner

CONDITIONER DETERMINING A CLOSED CONDITION OF AN EXPANSION VALVE

CROSS-REFERENCE TO RELATED APPLICATIONS

This U.S. National stage application claims priority under 35 U.S.C. § 119(a) to Japanese Patent Application No. 2014-253258, filed in Japan on Dec. 15, 2014, the entire contents of which are hereby incorporated herein by reference.

TECHNICAL FIELD

The present invention relates to an air conditioning apparatus, and particularly relates to an air conditioning apparatus having a refrigerant circuit configured by connecting a compressor, an outdoor heat exchanger, an expansion valve, and an indoor heat exchanger; the air conditioning apparatus performing an air-cooling operation in which refrigerant is circulated sequentially through the compressor, the outdoor heat exchanger, the expansion valve, and the indoor heat exchanger.

BACKGROUND ART

Conventionally, there have been air conditioning apparatuses which have a refrigerant circuit configured by connecting a compressor, an outdoor heat exchanger, an indoor expansion valve (an expansion valve), and an indoor heat exchanger. Such air conditioning apparatuses include those which perform an air-cooling operation in which refrigerant is circulated sequentially through the compressor, the outdoor heat exchanger, the expansion valve, and the indoor heat exchanger. In such an air-cooling operation, an opening degree of the expansion valve is controlled in order to regulate the flow rate of refrigerant flowing through the indoor heat exchanger, but in order to expand the range for regulating the refrigerant flow rate at this time, the range for controlling the opening degree of the expansion valve is preferably expanded to a low opening degree range that is near to fully closed.

As a countermeasure, there are air conditioning apparatuses such as that disclosed in Japanese Laid-open Patent Publication No. 2014-66424, in which, when the opening degree of the expansion valve is controlled so that the temperature of refrigerant in an outlet of the expansion valve reaches a target temperature, the expansion valve is determined to be in a fully closed state (closed-valve sensing) and the opening degree of the expansion valve is forcibly increased when the temperature of the refrigerant in the outlet of the expansion valve has risen despite the opening degree of the expansion valve having been reduced in order to lower the temperature of the refrigerant in the outlet of the expansion valve to the target temperature.

SUMMARY

The technique for closed-valve sensing in the aforementioned Japanese Laid-open Patent Publication No. 2014-66424 utilizes, as the condition for determining whether or not the expansion valve has reached the fully closed state (closed-valve condition), the temperature change when the expansion valve has reached the fully closed state and the temperature of the refrigerant in the outlet of the expansion valve rises due to the effect of the ambient temperature. Therefore, when the refrigerant temperature in the outlet of the expansion valve is low, this temperature change is manifested clearly and closed-valve sensing can be performed with precision. However, when the refrigerant temperature in the outlet of the expansion valve is high, this temperature change is not likely to be manifested clearly and closed-valve sensing sometimes cannot be performed with precision. The expansion valve thereby reaches the fully closed state and refrigerant ceases to flow to the indoor heat exchanger, therefore creating the risk that it will no longer be possible to perform the desired air-cooling operation.

There are various control formats for controlling the opening degree of an expansion valve other than controlling the opening degree of the expansion valve so that the temperature of the refrigerant in the outlet of the expansion valve reaches a target temperature, such as controlling the opening degree of the expansion valve so that the degree of superheating of the refrigerant in the outlet of the indoor heat exchanger reaches a target degree of superheating, but in any format for controlling the opening degree of the expansion valve, improving the precision of closed-valve sensing is an object when the same technique of closed-valve sensing as in Patent Literature 1 is used.

An object of the present invention is to enable closed-valve sensing of an expansion valve to be performed with precision in an air conditioning apparatus having a refrigerant circuit configured by connecting a compressor, an outdoor heat exchanger, the expansion valve, and an indoor heat exchanger; the air conditioning apparatus performing an air-cooling operation in which refrigerant is circulated sequentially through the compressor, the outdoor heat exchanger, the expansion valve, and the indoor heat exchanger.

An air conditioning apparatus according to a first aspect has a refrigerant circuit configured by connecting a compressor, an outdoor heat exchanger, an expansion valve, and an indoor heat exchanger, and performs an air-cooling operation in which refrigerant is circulated sequentially through the compressor, the outdoor heat exchanger, the expansion valve, and the indoor heat exchanger. The air conditioning apparatus has: a liquid-side temperature sensor to detect the refrigerant temperature in an inlet or an intermediate part of the indoor heat exchanger and a gas-side temperature sensor to detect the refrigerant temperature in an outlet of the indoor heat exchanger, the temperature sensors being provided in a section of the refrigerant circuit that extends from an outlet of the expansion valve to the outlet of the indoor heat exchanger; and a controller to control the compressor and the expansion valve during the air-cooling operation. During the air-cooling operation in this aspect, the controller controls an opening degree of the expansion valve so that the degree of superheating of the refrigerant, obtained by subtracting the refrigerant temperature detected by the liquid-side temperature sensor from the temperature of the refrigerant detected by the gas-side temperature sensor, reaches a target degree of superheating. The air conditioning apparatus further has an intake pressure sensor to detect refrigerant pressure in an intake side of the compressor and an indoor temperature sensor to detect the temperature of the air in an air-conditioned space cooled by the indoor heat exchanger, and the controller determines that the expansion valve is in a fully closed state when the two refrigerant temperatures detected by the liquid-side temperature sensor and the gas-side temperature sensor satisfy a predetermined closed-valve condition in relation to an evaporation temperature of the refrigerant obtained by converting the refrigerant pressure detected by the intake pressure sensor to a saturation temperature of the refrigerant, and in relation to the air temperature detected by the indoor temperature sensor.

In this aspect, as described above, the control format employed to control the opening degree of the expansion valve involves the refrigerant temperature in the outlet of the indoor heat exchanger and the refrigerant temperature in the inlet or the intermediate part of the indoor heat exchanger being detected by the gas-side temperature sensor and the liquid-side temperature sensor, and the degree of superheating of the refrigerant, obtained by subtracting the refrigerant temperature detected by the liquid-side temperature sensor from the temperature of the refrigerant detected by the gas-side temperature sensor, being brought to the target degree of superheating. Therefore, a considered possibility is to perform closed-valve sensing, utilizing the temperature change when the ambient temperature effects a rise in the refrigerant temperature in the inlet or the intermediate part of the indoor heat exchanger when the expansion valve has reached a fully closed state, as with Patent Literature 1.

However, when the refrigerant temperature in the inlet or the intermediate part of the indoor heat exchanger is high in this case, the temperature change is not likely to be manifested clearly, and closed-valve sensing sometimes cannot be performed with precision, as with Patent Literature 1.

Therefore, in this aspect, the expansion valve is determined to be in a fully closed state (closed-valve sensing) when the two refrigerant temperatures detected by the liquid-side temperature sensor and the gas-side temperature sensor satisfy a predetermined closed-valve condition in relation to an evaporation temperature of the refrigerant obtained by converting the refrigerant pressure in the intake side of the compressor detected by the intake pressure sensor to a saturation temperature of the refrigerant, and in relation to the air temperature of the air-conditioned space cooled by the indoor heat exchanger, the air temperature being detected by the indoor temperature sensor, as described above. Specifically, in this aspect, unlike Patent Literature 1, two refrigerant temperatures including not only the refrigerant temperature in the inlet or the intermediate part of the indoor heat exchanger but also the refrigerant temperature in the outlet of the indoor heat exchanger are used as the closed-valve condition for the expansion valve; also used as this condition is a value based on an air temperature as the ambient temperature and the evaporation temperature of the refrigerant obtained by converting the refrigerant pressure detected by the intake pressure sensor. In this aspect, the evaporation temperature of the refrigerant obtained by converting the refrigerant pressure detected by the intake pressure sensor represents an accurate evaporation temperature, unlike the refrigerant temperature in the inlet or the intermediate part of the indoor heat exchanger, even when the expansion valve has reached the fully closed state and refrigerant has ceased to flow to the indoor heat exchanger.

Closed-valve sensing of the expansion valve can thereby be performed with greater precision in this aspect than in the case of Patent Literature 1, in which the temperature change used as the closed-valve condition is the temperature change when the expansion valve has reached the fully closed state and the temperature of the refrigerant in the outlet of the expansion valve rises due to the effect of the ambient temperature.

An air conditioning apparatus according to a second aspect is the air conditioning apparatus according to the first aspect, wherein the closed-valve condition includes a first closed-valve condition, which is that the two refrigerant temperatures detected by the liquid-side temperature sensor and the gas-side temperature sensor are lower than a first threshold temperature set on the basis of the air temperature detected by the indoor temperature sensor, and higher than a second threshold temperature set on the basis of the refrigerant evaporation temperature obtained by converting the refrigerant pressure detected by the intake pressure sensor to a refrigerant saturation temperature.

In a case in which the opening degree of the expansion valve is controlled so that the degree of superheating of the refrigerant reaches the target degree of superheating, the refrigerant temperature in the inlet or the intermediate part of the indoor heat exchanger indicates a temperature near the refrigerant evaporation temperature when the indoor expansion valve is in an open state, and when the expansion valve reaches the fully closed state, a state manifests in which the refrigerant temperature in the inlet or the intermediate part of the indoor heat exchanger deviates from the refrigerant evaporation temperature, and the refrigerant temperature in the inlet or the intermediate part of the indoor heat exchanger and the refrigerant temperature in the outlet of the indoor heat exchanger rise so as to approach the air temperature.

Therefore, in this aspect, such a state of the two refrigerant temperatures is sensed by determining whether or not the two refrigerant temperatures satisfy the first closed-valve condition. Therefore, in this aspect, closed-valve sensing for the expansion valve can be performed with precision.

An air conditioning apparatus according to a third aspect is the air conditioning apparatus according to the second aspect, wherein the closed-valve condition further includes a second closed-valve condition, which is that the two refrigerant temperatures detected by the liquid-side temperature sensor and the gas-side temperature sensor are lower than the first threshold temperature set on the basis of the air temperature detected by the indoor temperature sensor, and higher than a third threshold temperature set on the basis of the average value of the air temperature detected by the indoor temperature sensor and the refrigerant evaporation temperature obtained by converting the refrigerant pressure detected by the intake pressure sensor to a refrigerant saturation temperature; and the closed-valve condition is satisfied when the first closed-valve condition or the second closed-valve condition is satisfied.

In an operating state in which the refrigerant evaporation temperature is high, even if the expansion valve reaches the fully closed state, there is not likely to be a clear state in which the refrigerant temperature in the inlet or the intermediate part of the indoor heat exchanger rises so as to deviate from the refrigerant evaporation temperature, and the condition "higher than the second threshold temperature" within the first closed-valve condition described above is not likely to be satisfied. This is because in an operating state in which the refrigerant evaporation temperature is high, even if the expansion valve is in an open state, the refrigerant evaporation temperature and the refrigerant temperature in the inlet or the intermediate part of the indoor heat exchanger are close to the air temperature. Therefore, it is preferable to mitigate the value of the threshold temperature for determining whether or not a state manifests in which the refrigerant temperature in the inlet or the intermediate part of the indoor heat exchanger rises so as to deviate from the refrigerant evaporation temperature, so that it is possible to also adapt to such an operating state in which the refrigerant evaporation temperature is high.

Therefore, the second closed-valve condition is added in this aspect, which is that the closed-valve condition is satisfied also when the two refrigerant temperatures are higher than the third threshold temperature set on the basis of the average value of the air temperature detected by the indoor temperature sensor and the refrigerant evaporation temperature obtained by converting the refrigerant pressure detected by the intake pressure sensor to a refrigerant saturation temperature. Therefore, in this aspect, closed-valve sensing for the expansion valve can be performed even in an operating state in which the refrigerant evaporation temperature is high.

An air conditioning apparatus according to a fourth aspect is the air conditioning apparatus according to the third aspect, wherein the controller controls a capacity of the compressor during the air-cooling operation so that either the refrigerant pressure detected by the intake pressure sensor reaches a target low pressure, or the refrigerant evaporation temperature obtained by converting the refrigerant pressure detected by the intake pressure sensor to a refrigerant saturation temperature reaches a target evaporation temperature.

In a case in which the capacity of the compressor is controlled so that the refrigerant pressure in the intake side of the compressor or the evaporation temperature obtained by converting this refrigerant pressure reaches a target value (the target low pressure or the target evaporation temperature), the refrigerant temperature in the inlet or the intermediate part of the indoor heat exchanger and the refrigerant evaporation temperature come to be near the air temperature when the target low pressure or the target evaporation temperature is set high in order to reduce the capacity of the compressor, even if the expansion valve is in an open state. Therefore, when the closed-valve condition includes only the first closed-valve condition, there is not likely to be a clear state in which the refrigerant temperature in the inlet or the intermediate part of the indoor heat exchanger rises so as to deviate from the refrigerant evaporation temperature, and the condition "higher than the second threshold temperature" is not likely to be satisfied, even if the expansion valve reaches the fully closed state. When the target low pressure or the target evaporation temperature is set low in order to increase the capacity of the compressor, there is likely to be a clear state in which the refrigerant temperature in the inlet or the intermediate part of the indoor heat exchanger rises so as to deviate from the refrigerant evaporation temperature when the expansion valve reaches the fully closed state. Regardless of this, when the closed-valve condition includes only the second closed-valve condition, a situation could occur in which the refrigerant temperature in the inlet or the intermediate part of the indoor heat exchanger does not satisfy the closed-valve condition when the refrigerant temperature in the inlet or the intermediate part of the indoor heat exchanger does not significantly rise even though the expansion valve has reached the fully closed state, because the third threshold temperature set on the basis of the average value of the air temperature and the refrigerant evaporation temperature is set to a higher temperature than the refrigerant evaporation temperature. Thus, when capacity control for the compressor is performed, there are cases in which it is difficult to perform closed-valve sensing for the expansion valve.

However, in this aspect, because the closed-valve condition includes both the first closed-valve condition and the second closed-valve condition as described above, closed-valve sensing for the expansion valve can be performed while capacity control for the compressor is performed.

An air conditioning apparatus according to a fifth aspect is the air conditioning apparatus according to any of the first through fourth aspects, wherein the closed-valve condition further includes a condition that the degree of superheating of the refrigerant is a positive value.

Regardless of whether the air conditioning apparatus is in an operating state in which the degree of superheating of the refrigerant is zero (or a negative value) and the refrigerant in the outlet of the indoor heat exchanger is in a wet state, the opening degree of the expansion valve would increase when the above-described closed-valve condition relying on the two refrigerant temperatures, the refrigerant evaporation temperature, and the air temperature is satisfied and forced valve-opening control is performed; therefore, there would be a risk that the refrigerant in the outlet of the indoor heat exchanger would reach a wet state having an even greater degree of wetness and the compressor would excessively draw in liquid refrigerant.

Therefore, in this aspect, the condition that the degree of superheating of the refrigerant is a positive value is added to the closed-valve condition, ensuring either that the refrigerant in the outlet of the indoor heat exchanger does not reach a wet state or that the compressor does not excessively draw in liquid refrigerant even when the closed-valve condition is satisfied and forced valve-opening control is performed. Therefore, in this aspect, closed-valve sensing for the expansion valve can be performed while ensuring that the compressor does not excessively draw in liquid refrigerant even if forced valve-opening control is performed.

An air conditioning apparatus according to a sixth aspect is the air conditioning apparatus according to any of the first through fifth aspects, wherein the closed-valve condition further includes a condition that the opening degree of the expansion valve is smaller than an open-valve-ensured opening degree at which refrigerant flow is ensured to be achieved, even taking into account an individual difference of the expansion valve.

When the opening degree of the expansion valve is controlled so that the degree of superheating of the refrigerant reaches the target degree of superheating in an opening degree range equal to or greater than the open-valve-ensured opening degree, the expansion valve does not reach the fully closed state and there is no need to perform closed-valve sensing such as is described above.

Therefore, in this aspect, the condition that the opening degree of the expansion valve is smaller than the open-valve-ensured opening degree is added to the closed-valve condition, and closed-valve sensing is performed only when the opening degree of the expansion valve is smaller than the open-valve-ensured opening degree. Therefore, in this aspect, closed-valve sensing can be performed appropriately only in cases in which there is a risk that the expansion valve will reach the fully closed state.

An air conditioning apparatus according to a seventh aspect is the air conditioning apparatus according to any of the first through sixth aspects, wherein the controller performs a forced valve-opening control to increase the opening degree of the expansion valve when the expansion valve is determined to be in the fully closed state.

In this aspect, the fully closed state can be avoided by forcibly opening the expansion valve during degree of superheating control, in which the expansion valve is determined by closed-valve sensing to be in the fully closed state.

DESCRIPTION OF EMBODIMENTS

An embodiment of the air conditioning apparatus according to the present invention is described below with reference to the drawings. The specific configuration of the embodiment of the air conditioning apparatus according to the present invention is not limited to the following embodiment, and can be altered within a range that does not deviate from the scope of the invention.

(1) Basic Configuration of the Air Conditioning Apparatus

Figure 1:
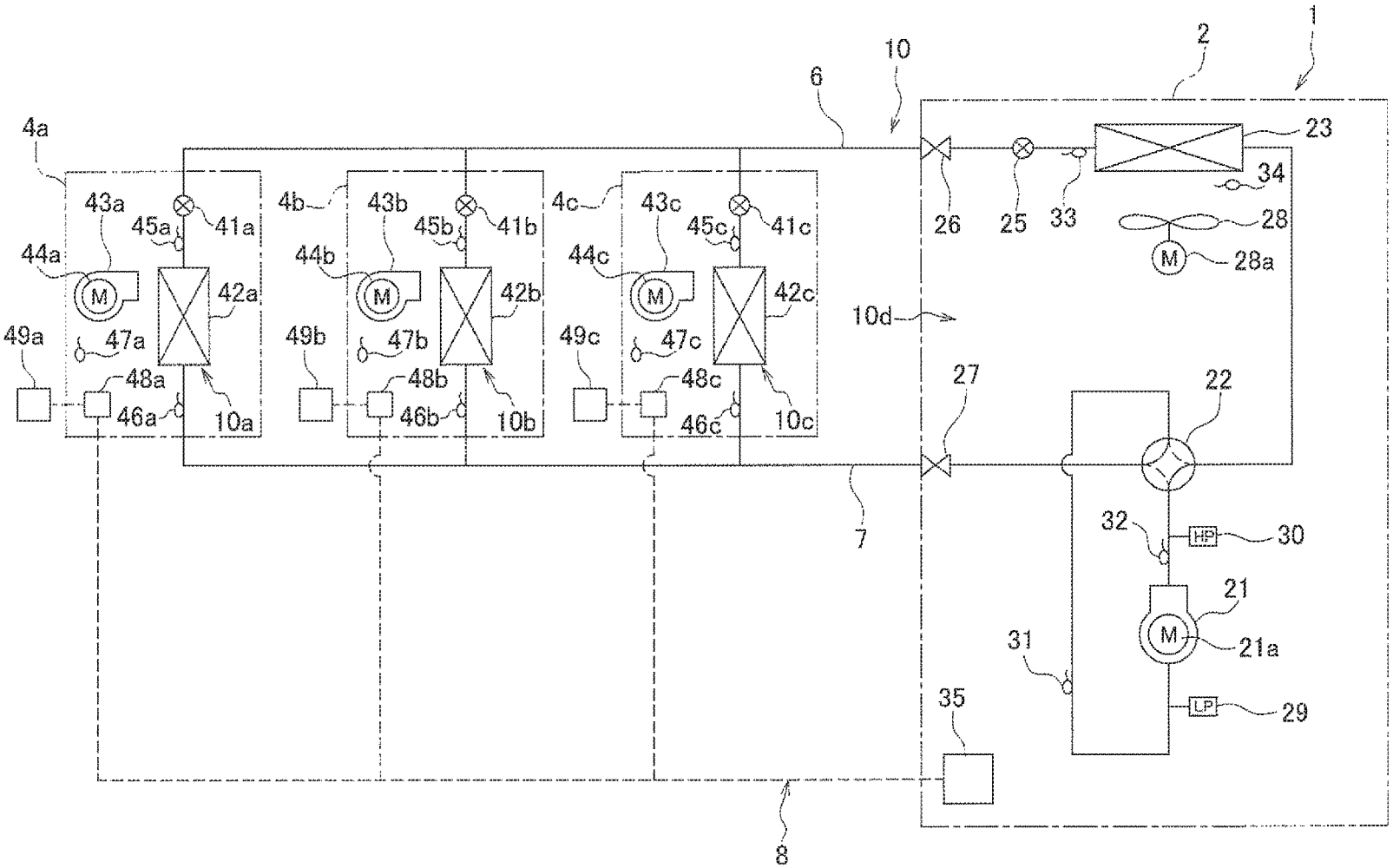
FIG. 1 is a schematic structural diagram of the air conditioning apparatus according to an embodiment of the present invention.

FIG. 1 is a schematic structural diagram of the air conditioning apparatus 1 according to an embodiment of the present invention. The air conditioning apparatus 1 is used for air conditioning a building or other indoor space by a vapor compression-type refrigerant cycle operation. The air conditioning apparatus 1 is mainly configured by connecting an outdoor unit 2 and a plurality (in this embodiment, three) of indoor units 4*a*, 4*b*, 4*c*. In this embodiment, the outdoor unit 2 and the plurality of indoor units 4*a*, 4*b*, 4*c* are connected to each other via a liquid refrigerant communication pipe 6 and a gas refrigerant communication pipe 7. In other words, the vapor compression-type refrigerant circuit 10 of the air conditioning apparatus 1 is configured by the outdoor unit 2 and the plurality of indoor units 4*a*, 4*b*, 4*c* being connected to each other via the refrigerant communication pipes 6, 7. The number of indoor units is not limited to three, and may be more or fewer than three.

<Indoor Unit>

The indoor units 4*a*, 4*b*, 4*c* are installed indoors. The indoor units 4*a*, 4*b*, 4*c* are connected to the outdoor unit 2 via the refrigerant communication pipes 6, 7, and configure a portion of the refrigerant circuit 10.

Next, the configuration of the indoor units 4*a*, 4*b*, 4*c* shall be described. Because the indoor unit 4*b* and the indoor unit 4*c* have the same configuration as the indoor unit 4*a*, only the configuration of the indoor unit 4*a* is described in this embodiment, and the configurations of the indoor units 4*b*, 4*c* respectively use the subscripts b and c in place of the subscript a denoting the components of the indoor unit 4*a*, descriptions of the components of the indoor units 4*b*, 4*c* being omitted.

The indoor unit 4*a* mainly has an indoor-side refrigerant circuit 10*a* (indoor-side refrigerant circuit 10*b*, 10*c* in the indoor unit 4*b*, 4*c*) configuring a portion of the refrigerant circuit 10. The indoor-side refrigerant circuit 10*a* mainly has an indoor expansion valve 41*a* and an indoor heat exchanger 42*a*.

The indoor expansion valve 41*a* is a valve to decompress refrigerant flowing through the indoor-side refrigerant circuit 10*a* to regulate the flow rate of the refrigerant. The indoor expansion valve 41*a* is an electric expansion valve connected to the liquid side of the indoor heat exchanger 42*a*.

The indoor heat exchanger 42*a* is a heat exchanger that functions as an evaporator of refrigerant and a radiator of refrigerant, and is configured by numerous heat transfer tubes and numerous fins. An indoor fan 43*a* for sending indoor air to the indoor heat exchanger 42*a* is provided near the indoor heat exchanger 42*a*. Due to indoor air being blown by the indoor fan 43*a* onto the indoor heat exchanger 42*a*, heat is exchanged between the refrigerant and in the indoor air in the indoor heat exchanger 42*a*. The indoor fan 43*a* is rotatably driven by an indoor fan motor 44*a*.

Various sensors are provided to the indoor unit 4*a*. A liquid-side temperature sensor 45*a* to detect the temperature Trla of refrigerant in a liquid state or in a gas-liquid two-phase state is provided to the liquid side of the indoor heat exchanger 42*a*. On the gas side of the indoor heat exchanger 42*a*, a gas-side temperature sensor 46*a* is provided to detect the temperature Trga of the gas-state refrigerant. On the side of the indoor unit 4*a* that has an intake port for indoor air, an indoor temperature sensor 47*a* is provided to detect the air temperature of the air-conditioned space cooled or heated by the indoor heat exchanger 42*a* of the indoor unit 4*a*, i.e., the indoor air temperature (indoor temperature Tra) in the indoor unit 4*a*. The indoor unit 4*a* has an indoor-side controller 48*a* to control the actions of the components configuring the indoor unit 4*a*. The indoor-side controller 48*a* has a microcomputer, memory, and the like provided to control the indoor unit 4*a*, and is capable of exchanging control signals and the like with the remote controller 49*a* for singularly operating the indoor unit 4*a* and exchanging control signals or the like with the outdoor unit 2. The remote controller 49*a* is a device for the user to implement various settings and/or issue operate/stop commands pertaining to air-conditioning operation. The indoor temperature sensor 47*a* may also be provided not only within the indoor unit 4*a*, but to the remote controller 49*a* as well.

<Outdoor Unit>

The outdoor unit 2 is installed outdoors. The outdoor unit 2 is connected to the indoor units 4*a*, 4*b*, 4*c* via the refrigerant communication pipes 6, 7 and configures a portion of the refrigerant circuit 10.

Next, the configuration of the outdoor unit 2 shall be described.

The outdoor unit 2 mainly has an outdoor-side refrigerant circuit 10*d* configuring a portion of the refrigerant circuit 10. The outdoor-side refrigerant circuit 10*d* mainly has a compressor 21, a four-way switching valve 22, an outdoor heat exchanger 23, an outdoor expansion valve 25, a liquid-side shutoff valve 26, and a gas-side shutoff valve 27.

The compressor 21 is a hermetic compressor in which a compression element (not shown) and a compressor motor 21*a* to rotatably drive the compression element are accommodated in a casing. The compressor motor 21*a* is designed so that electric power is supplied via an inverter device (not shown), and the operating capacity can be varied by changing the output frequency (i.e., the rotational speed) of the inverter device.

The four-way switching valve 22 is a valve for switching the direction of refrigerant flow. During the air-cooling operation, which is one example of an air-conditioning operation, the four-way switching valve 22 connects a discharge side of the compressor 21 and a gas side of the outdoor heat exchanger 23, and connects the intake side of the compressor 21 and the gas refrigerant communication pipe 7 (refer to the solid lines of the four-way switching valve 22 in FIG. 1), in order to cause the outdoor heat exchanger 23 to function as a radiator of the refrigerant compressed in the compressor 21 and cause the indoor heat exchangers 42*a*, 42*b*, 42*c* to function as evaporators of the refrigerant from which heat was radiated in the outdoor heat exchanger 23. During an air-warming operation, which is one example of an air-conditioning operation, the four-way switching valve 22 can connect the discharge side of the compressor 21 and the gas refrigerant communication pipe 7, and can connect the intake side of the compressor 21 and the gas side of the outdoor heat exchanger 23 (refer to the dashed lines of the four-way switching valve 22 in FIG. 1), in order to cause the indoor heat exchangers 42*a*, 42*b*, 42*c* to function as radiators of the refrigerant compressed in the compressor 21 and cause the outdoor heat exchanger 23 to function as an evaporator of the refrigerant from which heat was radiated in the indoor heat exchangers 42*a*, 42*b*, 42*c*.

The outdoor heat exchanger 23 is a heat exchanger that functions as a radiator of the refrigerant and an evaporator of the refrigerant, and is configured by numerous heat transfer tubes and numerous fins. Provided in proximity to the outdoor heat exchanger 23 is an outdoor fan 28 for sending outdoor air to the outdoor heat exchanger 23. Due to outdoor air being blown by the outdoor fan 28 onto the outdoor heat exchanger 23, heat is exchanged between the refrigerant and the outdoor air in the outdoor heat exchanger 23. The outdoor fan 28 is rotatably driven by an outdoor fan motor 28*a*.

The outdoor expansion valve 25 decompresses refrigerant flowing through the outdoor-side refrigerant circuit 10*d*. The outdoor expansion valve 25 is an electric expansion valve connected to the liquid side of the outdoor heat exchanger 23.

The liquid-side shutoff valve 26 and the gas-side shutoff valve 27 are provided to the connection ports of the exterior devices and pipes (specifically, the liquid refrigerant communication pipe 6 and the gas refrigerant communication pipe 7). The liquid-side shutoff valve 26 is connected to the outdoor expansion valve 25. The gas-side shutoff valve 27 is connected to the four-way switching valve 22.

Various sensors are provided to the outdoor unit 2. The outdoor unit 2 is provided with an intake pressure sensor 29 to detect the intake pressure Ps of the compressor 21, a discharge pressure sensor 30 to detect the discharge pressure Pd of the compressor 21, an intake temperature sensor 31 to detect the intake temperature Ts of the compressor 21, and a discharge temperature sensor 32 to detect the discharge temperature Td of the compressor 21. The intake temperature sensor 31 is provided to the intake side of the compressor 21. A liquid-side temperature sensor 33 to detect the temperature Tol of refrigerant in a liquid state or in a gas-liquid two-phase state is provided to the liquid side of the outdoor heat exchanger 23. An outdoor air temperature sensor 34 to detect the temperature of the outdoor air (outside air temperature Ta) in the outdoor unit 2 is provided to the side of the outdoor unit 2 that has an intake port for outdoor air. The outdoor unit 2 has an outdoor-side controller 35 to control the actions of the components configuring the outdoor unit 2. The outdoor-side controller 35 has a microcomputer and memory provided in order to control the outdoor unit 2, and an inverter circuit or the like to control the compressor motor 21*a*, and is capable of exchanging control signals and the like between the indoor units 4*a*, 4*b*, 4*c* and the indoor-side controllers 48*a*, 48*b*, 48*c*.

<Refrigerant Communication Pipes>

The refrigerant communication pipes 6, 7 are refrigerant pipes constructed on-site when the air conditioning apparatus 1 is installed. The liquid refrigerant communication pipe 6 extends from a liquid-side connection port (in this embodiment, the liquid-side shutoff valve 26) of the outdoor unit 2, branches to the plurality (in this embodiment, three) of indoor units 4*a*, 4*b*, 4*c* midway through, and extends to liquid-side connection ports (in this embodiment, refrigerant pipes connected to the indoor expansion valves 41*a*, 41*b*, 41*c*) of the indoor units 4*a*, 4*b*, 4*c*. The gas refrigerant communication pipe 7 extends from a gas-side connection port (in this embodiment, the gas-side shutoff valve 27) of the outdoor unit 2, branches to the plurality (in this embodiment, three) of indoor units 4*a*, 4*b*, 4*c* midway through, and extends to gas-side connection ports (in this embodiment, refrigerant pipes connected to the gas sides of the indoor heat exchangers 42*a*, 42*b*, 42*c*) of the indoor units 4*a*, 4*b*, 4*c*. The refrigerant communication pipes 6, 7 can have various lengths and/or pipe diameters in accordance with the conditions in which the outdoor unit 2 and the indoor units 4*a*, 4*b*, 4*c* are installed.

<Controller>

Figure 2:
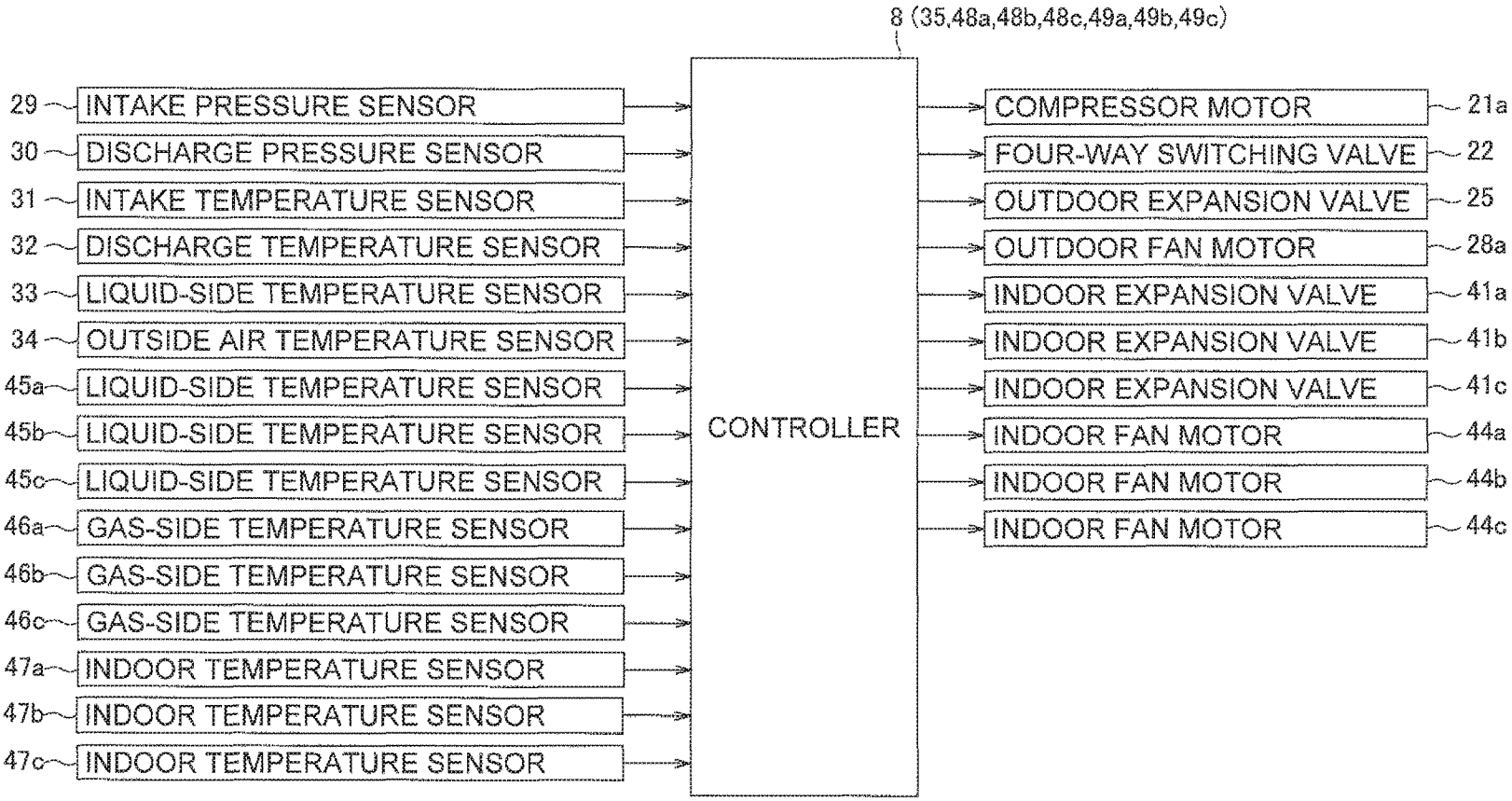
FIG. 2 is a control block diagram of the air conditioning apparatus.

Remote controllers 49*a*, 49*b*, 49*c* for individually operating the indoor units 4*a*, 4*b*, 4*c*, the indoor-side controllers 48*a*, 48*b*, 48*c* of the indoor units 4*a*, 4*b*, 4*c*, and the outdoor-side controller 35 of the outdoor unit 2 configure a controller 8 to control the overall operation of the air conditioning apparatus 1. The controller 8 is connected so as to be able to receive detection signals from the various sensors 29 to 34, 45*a* to 45*c*, 46*a* to 46*c*, 47*a* to 47*c*, etc., as shown in FIG. 2. The controller 8 is configured so as to be able to perform the air-cooling operation and other air-conditioning operations by controlling the various devices and valves 21*a*, 22, 25, 28*a*, 41*a* to 41*c*, and 44*a* to 44*c* on the basis of these detection signals etc. FIG. 2 is a control block diagram of the air-conditioning apparatus 1.

As described above, the air conditioning apparatus 1 has a refrigerant circuit 10 configured by connecting the compressor 21, the outdoor heat exchanger 23, the indoor expansion valves 41*a*, 41*b*, 41*c* (expansion valves), and the indoor heat exchangers 42*a*, 42*b*, 42*c*. The air conditioning apparatus 1 performs the air-cooling operation and other air-conditioning operations in which refrigerant is sequentially circulated through the compressor 21, the outdoor heat exchanger 23, the indoor expansion valves 41*a*, 41*b*, 41*c* (expansion valves), and the indoor heat exchangers 42*a*, 42*b*, 42*c*, as is described hereinafter. In the air conditioning apparatus 1, air-conditioning operations are performed so that indoor temperatures Tra, Trb, Trc in the indoor units 4*a*, 4*b*, 4*c* reach target indoor temperatures Tras, Trbs, Trcs, which are target values for the indoor temperatures in the indoor units 4*a*, 4*b*, 4*c*. The user uses the remote controllers 49*a*, 49*b*. 49*c* to set these target indoor temperatures Tras, Trbs, Trcs.

(2) Basic Action and Basic Control of the Air Conditioning Apparatus

<Basic Action>

The basic action of the air-conditioning operation (air-cooling operation and air-warming operation) of the air conditioning apparatus 1 is next described with reference to FIG. 1.

—Air-Cooling Operation—

When a command for the air-cooling operation is issued from the remote controllers 49*a*, 49*b*, 49*c*, the four-way switching valve 22 is switched to an air-cooling operation state (the state shown by the solid lines of the four-way switching valve 22 in FIG. 1), and the compressor 21, the outdoor fan 28, and indoor fans 43*a*, 43*b*, 43*c* start up.

At this time, the low-pressure gas refrigerant in the refrigerant circuit 10 is taken into the compressor 21 and compressed to become a high-pressure gas refrigerant. This high-pressure gas refrigerant is fed to the outdoor heat exchanger 23 through the four-way switching valve 22. The high-pressure gas refrigerant sent to the outdoor heat exchanger 23 is condensed by undergoing heat exchange with outdoor air fed by the outdoor fan 28 and being cooled to become high-pressure liquid refrigerant in the outdoor heat exchanger 21, which functions as a radiator of the refrigerant. The high-pressure liquid refrigerant is sent from the outdoor unit 2 to the indoor units 4*a*, 4*b*, 4*c* via the outdoor expansion valve 25, the liquid-side shutoff valve 26 and the liquid refrigerant communication pipe 6.

The high-pressure liquid refrigerant sent to the indoor units 4*a*, 4*b*, 4*c* is decompressed by the indoor expansion valves 41*a*, 41*b*, 41*c* to become low-pressure refrigerant in gas-liquid two-phase state. The low-pressure refrigerant in a gas-liquid two-phase state is sent to the indoor heat exchangers 42*a*, 42*b*, 42*c*. The low-pressure refrigerant in a gas-liquid two-phase state sent to the indoor heat exchangers 42*a*, 42*b*, 42*c* is evaporated by heat exchange with indoor air fed by the indoor fans 43*a*, 43*b*, 43*c* and is heated to become low-pressure gas refrigerant in the indoor heat exchangers 42*a*, 42*b*, 42*c*, which function as evaporators of the refrigerant. The low-pressure gas refrigerant is sent from the indoor units 4*a*, 4*b*, 4*c* to the outdoor unit 2 via the gas refrigerant communication pipe 7.

The low-pressure gas refrigerant sent to the outdoor unit 2 is again taken into the compressor 21 via the gas-side shutoff valve 27 and the four-way switching valve 22.

—Air-Warming Operation—

When a command for the air-warning operation is issued from the remote controllers 49*a*, 49*b*, 49*c*, the four-way switching valve 22 is switched to an air-warming operation state (the state shown by the dashed lines of the four-way switching valve 22 in FIG. 1), and the compressor 21, the outdoor fan 28, and the indoor fans 43*a*, 43*b*, 43*c* start up.

At this time, the low-pressure gas refrigerant in the refrigerant circuit 10 is taken into the compressor 21 and compressed to become a high-pressure gas refrigerant. The high-pressure gas refrigerant is sent from the outdoor unit 2 to the indoor units 4*a*, 4*b*, 4*c* via the four-way switching valve 22, the gas-side shutoff valve 27 and the gas refrigerant communication pipe 7.

The high-pressure gas refrigerant sent to the indoor units 4*a*, 4*b*, 4*c* is sent to the indoor heat exchangers 42*a*, 42*b*, 42*c*. The high-pressure gas refrigerant sent to the indoor heat exchangers 42*a*, 42*b*, 42*c* is condensed by undergoing heat exchange with indoor air fed by the indoor fans 43*a*, 43*b*, 43*c* and being cooled to become high-pressure liquid refrigerant in the indoor heat exchangers 42*a*, 42*b*, 42*c*, which function as radiators of the refrigerant. The high-pressure liquid refrigerant is decompressed by the indoor expansion valves 41*a*, 41*b*, 41*c*. The refrigerant decompressed by the indoor expansion valves 41*a*, 41*b*, 41*c* is sent from the indoor units 4*a*, 4*b*, 4*c* to the outdoor unit 2 via the gas refrigerant communication pipe 7.

The refrigerant sent to the outdoor unit 2 is sent to the outdoor expansion valve 25 via the liquid-side shutoff valve 26 and decompressed by the outdoor expansion valve 25 to become low-pressure refrigerant in a gas-liquid two-phase state. The low-pressure refrigerant in a gas-liquid two-phase state is sent to the outdoor heat exchanger 23. The low-pressure refrigerant in a gas-liquid two-phase state sent to the outdoor heat exchanger 23 is evaporated by undergoing heat exchange with outdoor air fed by the outdoor fan 28 and being heated to become low-pressure gas refrigerant in the outdoor heat exchanger 23, which functions as an evaporator of the refrigerant. The low-pressure refrigerant in a gas state is again taken into the compressor 21 by way of the four-way switching valve 22.

<Basic Control>

In the air-conditioning operations (air-cooling operation and air-warming operation) described above, control of air-conditioning capability (air-cooling capability and air-warming capability) such as is described below is performed so that the indoor temperatures Tra, Trb, Trc in the indoor units 4*a*, 4*b*, 4*c* reach the target indoor temperatures Tras, Trbs, Trcs in the indoor units 4*a*, 4*b*, 4*c*. In this embodiment, the user uses the remote controllers 49*a*, 49*b*, 49*c* to set the target indoor temperatures Tras, Trbs, Trcs.

—During Air-Cooling Operation—

When the air-conditioning operation is the air-cooling operation, the controller 8 controls the opening degrees of the indoor expansion valves 41*a*, 41*b*, 41*c* (expansion valves) so that the degrees of superheating SHra, SHrb, SHrc of the refrigerant in the outlets of the indoor heat exchangers 42*a*, 42*b*, 42*c* reach target degrees of superheating SHras, SHrbs, SHrcs (referred to below as "degree of superheating control"). In this embodiment, the degrees of superheating SHra, SHrb, SHrc of the refrigerant are obtained by subtracting refrigerant temperatures Trga, Trlb, Trlc detected by the liquid-side temperature sensors 45*a*, 45*b*, 45*c* from temperatures Trga, Trgb, Trgc of the refrigerant on the gas sides of the indoor heat exchangers 42*a*, 42*b*, 42*c*, which are detected by the gas-side temperature sensors 46*a*, 46*b*, 46*c*.

The controller 8 controls the degrees of superheating through the indoor expansion valves 41*a*, 41*b*, 41*c*, and also controls the capacity of the compressor 21 on the basis of a target evaporation temperature Tes.

The capacity of the compressor 21 is controlled by controlling the rotational speed (operating frequency) of the compressor 21 (more specifically, the compressor motor 21*a*). Specifically, the rotational speed of the compressor 21 is controlled so that an evaporation temperature Te of the refrigerant, which corresponds to a low pressure Pe of the refrigerant circuit 10, reaches the target evaporation temperature Tes. In this embodiment, the term "low pressure Pe" means a pressure representative of low-pressure refrigerant flowing from the outlets of the indoor expansion valves 41*a*, 41*b*, 41*c* through the indoor heat exchangers 42*a*, 42*b*, 42*c* to the intake side of the compressor 21 during the air-cooling operation. In this embodiment, an intake pressure Ps, which is the refrigerant pressure detected by the intake pressure sensor 29, is used as the low pressure Pe, and a value obtained by converting the intake pressure Ps to a saturation temperature of the refrigerant is the evaporation temperature Te of the refrigerant.

The target evaporation temperature Tes in capacity control (rotational speed control) for the compressor 21 is determined in the controller 8 on the basis of required values ΔQCa, ΔQCb, ΔQCc pertaining to the air-cooling capabilities in the indoor units 4*a*, 4*b*, 4*c* during the air-cooling operation.

Specifically, first, temperature differences ΔTCra, ΔTCrb, ΔTCrc are obtained by subtracting the target indoor temperatures Tras, Trbs, Trcs from the indoor temperatures Tra, Trb, Trc during the air-cooling operation. These temperature differences ΔTCra, ΔTCrb, ΔTCrc are used as a basis to calculate the required values ΔQCa, ΔQCb, ΔQCc pertaining to the air-cooling capabilities of the indoor units 4*a*, 4*b*, 4*c* during the air-cooling operation. In this embodiment, when the temperature differences ΔTCra, ΔTCrb, ΔTCrc are positive values, i.e., when the indoor temperatures Tra, Trb, Trc have not yet reached the target indoor temperatures Tras, Trbs, Trcs, it means that an increase in the air-cooling capabilities is required, and greater absolute values for these differences mean that the degree of the request for increased air-cooling capabilities is greater. When the temperature differences ΔTCra, ΔTCrb, ΔTCrc are negative values, i.e., when the indoor temperatures Tra, Trb, Trc have reached the target indoor temperatures Tras, Trbs, Trcs, it means that a decrease in the air-cooling capabilities is required, and greater absolute values for these differences mean that the degree of the request for decreased air-cooling capabilities is greater. Therefore, the required values ΔQCa, ΔQCb, ΔQCc pertaining to the air-cooling capabilities are also values that mean the direction and degree of the increase or decrease in the air-cooling capabilities, as with the temperature differences ΔTCra, ΔTCrb, ΔTCrc.

When an increase in the air-cooling capabilities is required, i.e., when the required values ΔQCa, ΔQCb, ΔQCc pertaining to the air-cooling capabilities are positive values, the target evaporation temperature Tes is determined so as to be lower than the current value in accordance with the degree of increase (the absolute values of the required values), and the rotational speed of the compressor 21 is thereby increased to increase the air-cooling capabilities. When a decrease in the air-cooling capabilities is required, i.e., when the required values ΔQCa, ΔQCb, ΔQCc pertaining to the air-cooling capabilities are negative values, the target evaporation temperature Tes is determined so as to be higher than the current value in accordance with the degree of decrease (the absolute values of the required values), and the rotational speed of the compressor 21 is thereby decreased to decrease the air-cooling capabilities.

In this embodiment, increase/decrease requests for the various air-cooling capabilities (the required values ΔQCa, ΔQCb, ΔQCc) are made in accordance with the temperature differences ΔTCra, ΔTCrb, ΔTCrc in the indoor units 4*a*, 4*b*, 4*c* during, the air-cooling operation. However, the target evaporation temperature Tes is a target value shared by all the indoor units 4*a*, 4*b*, 4*c*. Therefore, it is imperative that the target evaporation temperature Tes be determined at a value that represents the increase/decrease requests of the air-cooling capabilities in all of the indoor units 4*a*, 4*b*, 4*c*. In view of this, the target evaporation temperature Tes is determined on the basis of the required value which, among the required values ΔQCa, ΔQCb, ΔQCc pertaining to the air-cooling capabilities, results in the lowest target evaporation temperature Tes. For example, when the required values ΔQCa, ΔQCb, ΔQCc pertaining to the air-cooling capabilities are the evaporation temperatures required in the indoor units 4*a*, 4*b*, 4*c*, the lowest of these required values is selected as the target evaporation temperature Tes. Specifically, when the required value ΔQCa serving as the evaporation temperature required in the indoor unit 4*a* is 5° C., the required value ΔQCb serving as the evaporation temperature required in the indoor unit 4*b* is 7° C., and the required value ΔQCc serving as the evaporation temperature required in the indoor unit 4*c* is 10° C., the lowest of these required values, which is the required value ΔQCa at 5° C., is selected as the target evaporation temperature Tes. When the required values ΔQCa, ΔQCb, ΔQCc pertaining to the air-cooling capabilities are values that indicate the degree of increase or decrease in the evaporation temperatures required in the indoor units 4*a*, 4*b*, 4*c*, the required value that among these values results in the greatest air-cooling capability is used as a basis to determine the target evaporation temperature Tes. Specifically, when the current target evaporation temperature Tes is 12° C. and, assuming that the required values ΔQCa, ΔQCb, ΔQCc pertaining to the air-cooling capabilities will indicate how much the evaporation temperature will be lowered, the required value ΔQCa required in the indoor unit 4*a* is 7° C. the required value ΔQCb required in the indoor unit 4*b* is 5° C., and the required value ΔQCc required in the indoor unit 4*c* is 2° C.; the highest of these required values, which is the required value ΔQCa at 7° C., is employed to set the temperature (=5° C.) obtained by subtracting from the current target evaporation temperature Tes (=12° C.) as the target evaporation temperature Tes.

In this embodiment, the rotational speed of the compressor 21 is controlled so that the evaporation temperature Te of the refrigerant reaches the target evaporation temperature Tes, but as an alternative, the rotational speed of the compressor 21 may be controlled so that the low pressure Pe (=intake pressure Ps) corresponding to the evaporation temperature Te of the refrigerant reaches a target low pressure Pes. In this case, the required values ΔQCa, ΔQcb, ΔQCc would also use values corresponding to the low pressure Pe and the target low pressure Pes.

—During Air-Warming Operation—

When the air-conditioning operation is the air-warming operation, the controller 8 controls the opening degrees of the indoor expansion valves 41*a*, 41*b*, 41*c* so that degrees of subcooling SCra, SCrb, SCrc of the refrigerant in the outlets of the indoor heat exchangers 42*a*, 42*b*, 42*c* reach target degrees of subcooling SCras, SCrbs, SCrcs (referred to below as "degree of subcooling control"). In this embodiment, the degrees of subcooling SCra, SCrb, SCrc are calculated from the discharge pressure Pd detected by the discharge pressure sensor 30, and the refrigerant temperatures Trla, Trlb, Trlc detected by the liquid-side temperature sensors 45*a*, 45*b*, 45*c*. More specifically, first, the discharge pressure Pd is converted to the saturation temperature of the refrigerant to obtain a condensation temperature Tc corresponding to a high pressure Pc of the refrigerant circuit 10. In this embodiment, the term "high pressure Pc" means a pressure representing high-pressure refrigerant that, during the air-warming operation, flows through a route leading from the discharge side of the compressor 21, through the indoor heat exchangers 42*a*, 42*b*, 42*c*, to the indoor expansion valves 41*a*, 41*b*, 41*c*. The condensation temperature Tc of the refrigerant means a state quantity equivalent to this high pressure Pc. The degrees of subcooling SCra, SCrb, SCrc are obtained by subtracting the refrigerant temperatures Trla, Trlb, Trlc in the liquid sides of the indoor heat exchangers 42*a*, 42*b*, 42*c* from the refrigerant condensation temperature Tc.

In addition to controlling the degrees of subcooling through the indoor expansion valves 41*a*, 41*b*, 41*c*, the controller 8 controls the capacity of the compressor 21 on the basis of a target condensation temperature Tcs.

The capacity of the compressor 21 is controlled by controlling the rotational speed (operating frequency) of the compressor 21 (more specifically, the compressor motor 21*a*), as with during the air-cooling operation. Specifically, the rotational speed of the compressor 21 is controlled so that the refrigerant condensation temperature Tc corresponding to the high pressure Pc of the refrigerant circuit 10 reaches the target condensation temperature Tcs.

The target condensation temperature Tcs in the capacity control (rotational speed control) for the compressor 21 is determined in the controller 8 on the basis of required values ΔQHa, ΔQHb, ΔQHc pertaining to the air-warming capabilities in the indoor units 4*a*, 4*b*, 4*c* during the air-warming operation.

Specifically, first, temperature differences ΔTHra, ΔTHrb, ΔTHrc are obtained by subtracting the indoor temperatures Tra, Trb, Trc from the target indoor temperatures Tras, Trbs, Trcs during the air-warming operation. On the basis of these temperature differences ΔTHra, ΔTHrb, ΔTHrc, the required values ΔQHa, ΔQHb, ΔQHc pertaining to the air-warming capabilities in the indoor units 4*a*, 4*b*, 4*c* during the air-warming operation are calculated. In this embodiment, when the temperature differences ΔTHra, ΔTHrb, ΔTHrc are positive values, i.e., when the indoor temperatures Tra, Trb, Trc have not yet reached the target indoor temperatures Tras, Trbs, Trcs, it means that an increase in the air-warming capabilities is required, and greater absolute values for these differences mean that the degree of the request for increased air-warming capabilities is greater. When the temperature differences ΔTHra, ΔTHrb, ΔTHrc are negative values, i.e., when the indoor temperatures Tra, Trb, Trc have reached the target indoor temperatures Tras, Trbs, Trcs, it means that a decrease in the air-warming capabilities is required, and greater absolute values for these differences mean that the degree of the request for decreased air-warming capabilities is greater. Therefore, the required values ΔQHa, ΔQHb, ΔQHc pertaining to the air-warming capabilities are also values that mean the direction and degree of the increase or decrease in the air-warming capabilities, as with the temperature differences ΔTHra, ΔTHrb, ΔTHrc.

When an increase in the air-warming capabilities is required, i.e., when the required values ΔQHa ΔQHb, ΔQHc pertaining to the air-warming capabilities are positive values, the target condensation temperature Tcs is determined so as to be higher than the current value in accordance with the degree of increase (the absolute values of the required values), and the rotational speed of the compressor 21 is thereby increased to increase the air-warming capabilities. When a decrease in the air-warming capabilities is required, i.e., when the required values ΔQHa, ΔQHb, ΔQHc pertaining to the air-warming capabilities are negative values, the target condensation temperature Tcs is determined so as to be lower than the current value in accordance with the degree of decrease (the absolute values of the required values), and the rotational speed of the compressor 21 is thereby decreased to decrease the air-warming capabilities.

In this embodiment, increase/decrease requests for the various air-warming capabilities (the required values ΔQHa, ΔQHb, ΔQHc) are made in accordance with the temperature differences ΔTHra, ΔTHrb, ΔTHrc in the indoor units 4*a*, 4*b*, 4*c* during the air-warming operation. However, as with the target evaporation temperature Tes, the target condensation temperature Tcs is a target value shared by all the indoor units 4*a*, 4*b*, 4*c*. Therefore, it is imperative that the target condensation temperature Tcs be determined at a value that represents the increase/decrease requests of the air-warming capabilities in all of the indoor units 4*a*, 4*b*, 4*c*. In view of this, the target condensation temperature Tcs is determined on the basis of the required value which, among the required values ΔQHa, ΔQHb, ΔQHc pertaining to the air-warming capabilities, results in the highest target condensation temperature Tcs. For example, when the required values ΔQHa, ΔQHb, ΔQHc pertaining to the air-warming capabilities are the condensation temperatures required in the indoor units 4*a*, 4*b*, 4*c*, the highest of these required values is selected as the target condensation temperature Tcs. Specifically, when the required value ΔQHa serving as the condensation temperature required in the indoor unit 4*a* is 45° C., the required value ΔQHb serving as the condensation temperature required in the indoor unit 4*b* is 43° C., and the required value ΔQHc serving as the condensation temperature required in the indoor unit 4*c* is 40° C., the highest of these required values, which is the required value ΔQHa at 45° C., is selected as the target condensation temperature Tcs. When the required values ΔQHa, ΔQHb, ΔQHc pertaining to the air-warming capabilities are values that indicate the degree of increase or decrease in the condensation temperatures required in the indoor units 4*a*, 4*b*, 4*c*, the required value that among these values results in the greatest air-warming capability is used as a basis to determine the target condensation temperature Tcs. Specifically, when the current target condensation temperature Tcs is 38° C. and, assuming that the required values ΔQHa, ΔQHb, ΔQHc pertaining to the air-warming capabilities will indicate how much the condensation temperature will be raised, the required value ΔQHa required in the indoor unit 4*a* is 7° C., the required value ΔQHb required in the indoor unit 4*b* is 5° C., and the required value ΔQHc required in the indoor unit 4*c* is 2° C.; the highest of these required values, which is the required value ΔQHa at 7° C., is employed to set the temperature (=45° C.) obtained by adding to the current target condensation temperature Tcs (=38° C.) as the target condensation temperature Tcs.

In this embodiment, the rotational speed of the compressor 21 is controlled so that the condensation temperature Tc of the refrigerant reaches the target condensation temperature Tcs, but as an alternative, the rotational speed of the compressor 21 may be controlled so that the high pressure Pc (=discharge pressure Pd) corresponding to the condensation temperature Tc of the refrigerant reaches a target high pressure Pcs. In this case, the required values ΔQHa, ΔQHb, ΔQHc would also use values corresponding to the high pressure Pc and the target high pressure Pcs.

Thus, in air-conditioning operations, rotational speed control for the compressor 21 and degree of superheating control through the indoor expansion valves 41*a*, 41*b*, 41*c* are performed as air-cooling capability control, and rotational speed control for the compressor 21 and degree of subcooling control through the indoor expansion valves 41*a*, 41*b*, 41*c* are performed as air-warming capability control.

(3) Closed-Valve Sensing and Forced Valve-Opening Control

In this embodiment, in the air-cooling operation, the flow rate of refrigerant flowing through the indoor heat exchangers 42*a*, 42*b*, 42*c* is regulated by performing degree of superheating control through the indoor expansion valves 41*a*, 41*b*, 41*c* (expansion valves) as described above, but in order to expand the range for regulating the refrigerant flow rate at this time, it is preferable to expand the range for controlling the opening degrees of the indoor expansion valves 41*a*, 41*b*, 41*c* to a low opening degree area that is near to fully closed.

However, when the indoor expansion valves 41*a*, 41*b*, 41*c* are used in a low opening degree area, the indoor expansion valves 41*a*, 41*b*, 41*c* will sometimes reach the fully closed state depending on the opening degree, due to individual differences in the valves. Once a valve has reached the frilly closed state, refrigerant ceases to flow to the indoor heat exchanger, and there will therefore be a decrease in the temperature difference between the temperature of the refrigerant in the gas side of the indoor heat exchanger as detected by the gas-side temperature sensor and the refrigerant temperature detected by the liquid-side temperature sensor. The degree of superheating of the refrigerant obtained from these refrigerant temperatures will then be less than the target degree of superheating, the controller 8 will therefore perform control to further reduce the opening degree of the indoor expansion valve that has reached the fully closed state as a result of degree of superheating control, and the fully closed state will therefore be unavoidable.

As a countermeasure, one considered possibility is to utilize the temperature change in the event that the ambient temperatures (in this embodiment, the indoor temperatures Tra, Trb, Trc) affect an increase in the refrigerant temperatures in the inlets or the intermediate parts of the indoor heat exchangers 42*a*, 42*b*, 42*c* when the indoor expansion valves 41*a*, 41*b*, 41*c* have reached the fully closed state (in this embodiment, the refrigerant temperatures Trla, Trlb, Trlc detected by the liquid-side temperature sensors 45*a*, 45*b*, 45*c*), and to determine whether or not the indoor expansion valves 41*a*, 41*b*, 41*c* are in the fully closed state (closed-valve sensing) and perform forced valve-opening control to forcibly increase the opening degrees of the indoor expansion valves which have been sensed as being closed, as with Patent Literature 1.

However, with this closed-valve sensing technique, when the refrigerant temperatures Trla, Trlb, Trlc detected by the liquid-side temperature sensors 45*a*, 45*b*, 45*c* are high, the temperature change described above is not likely to be clearly manifested, and closed-valve sensing sometimes cannot be performed with precision. Therefore, there is a risk that the indoor expansion valves 41*a*, 41*b*, 41*c* will reach the fully closed state, that a cessation of refrigerant flow to the indoor heat exchangers 42*a*, 42*b*, 42*c* will be unavoidable, and that it will not be possible to perform the desired air-cooling operation. Particularly, in this embodiment, when the capacity (i.e., air-cooling capability) of the compressor 21 is reduced by rotational speed control for the compressor 21 such as is described above, the target low pressure Pes or the target evaporation temperature Tes will sometimes be set high, and such situations in which closed-valve sensing cannot be performed with precision could frequently occur.

In view of this, in the air-cooling operation that accompanies the degree of superheating control through the indoor expansion valves 41*a*, 41*b*, 41*c* in the air conditioning apparatus 1, when the two sets of refrigerant temperatures Trla, Trlb, Trlc, Trga, Trgb, Trgc detected by the liquid-side temperature sensors 45*a*, 45*b*, 45*c* and the gas-side temperature sensors 46*a*, 46*b*, 46*c* satisfy a predetermined closed-valve condition in relation to the refrigerant evaporation temperature Te obtained by converting the refrigerant pressure Ps detected by the intake pressure sensor 29 to a saturation temperature of the refrigerant and the indoor temperatures Tra, Trb, Trc detected by the indoor temperature sensors 47*a*, 47*b*, 47*c*, the controller 8 determines that the indoor expansion valves 41*a*, 41*b*, 41*c* are in the fully closed state (closed-valve sensing) and performs forced valve-opening control to increase the opening degrees MVa, MVb, MVc of the indoor expansion valves 41*a*, 41*b*, 41*c*.

Figure 3:
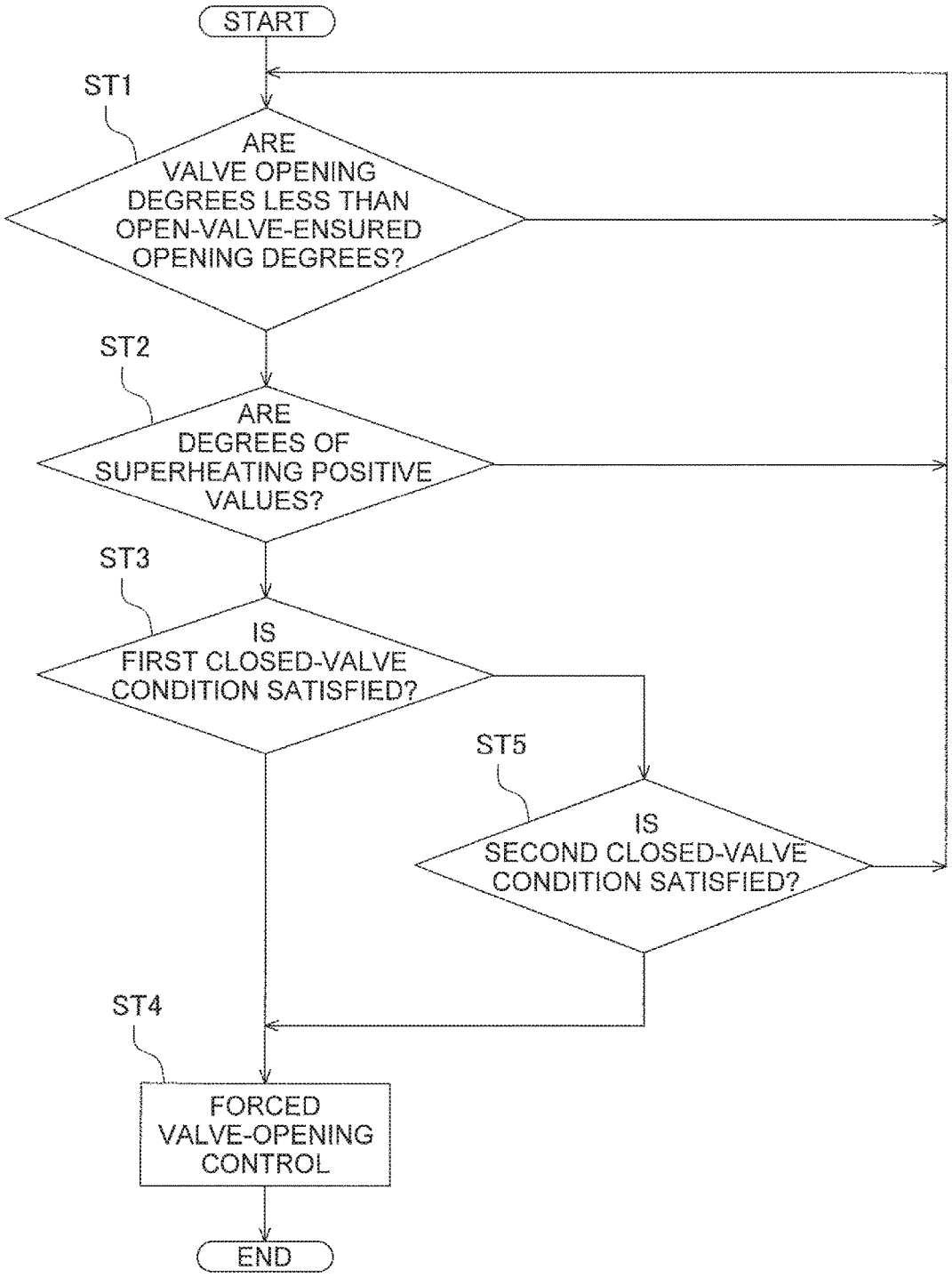
FIG. 3 is a flowchart showing closed-valve sensing and forced valve-opening control.
Figure 4:
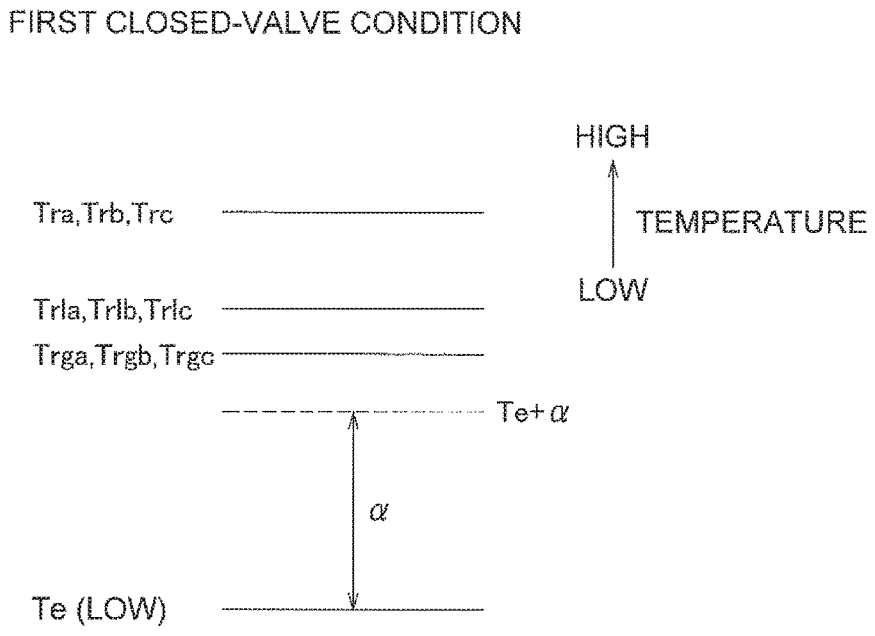
FIG. 4 is an illustration of a first closed-valve condition.
Figure 5:
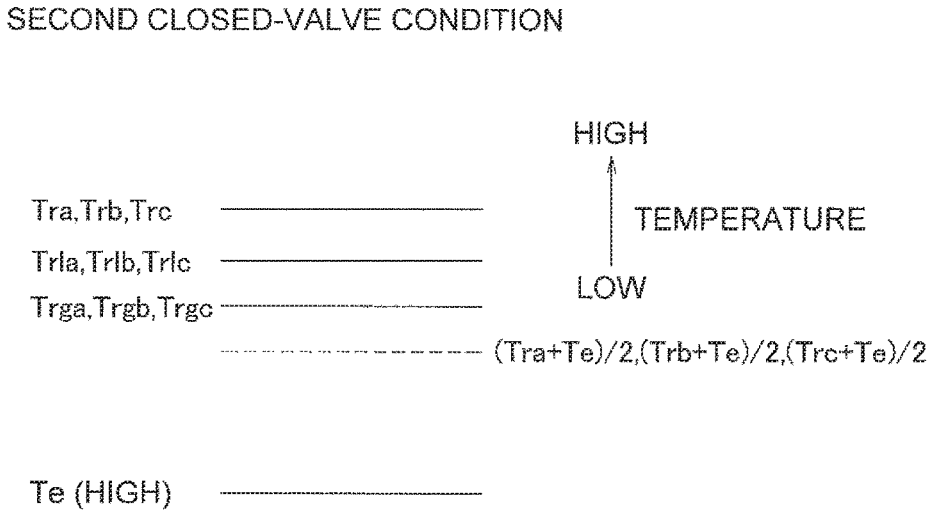
FIG. 5 is an illustration of a second closed-valve condition.

Next, the closed-valve sensing and the forced valve-opening control in the degree of superheating control through the indoor expansion valves 41*a*, 41*b*, 41*c* will be described using FIGS. 3 to 5. In this embodiment, FIG. 3 is a flowchart showing the closed-valve sensing and the forced valve-opening control. FIG. 4 is an illustration of a first closed-valve condition. FIG. 5 is an illustration of a second closed-valve condition. In this embodiment, the rotational speed control for the compressor 21 as described above results in an operative state in which the target low pressure Pes or the target evaporation temperature Tes are varied on the basis of the air-cooling capabilities required by the indoor units 4*a*, 4*b*, 4*c*. In the actual degree of superheating control, it is usually the case that forced valve-opening control is performed with any one of the indoor expansion valves 41*a*, 41*b*, 41*c* sensed as being closed, but for the sake of convenience in the description below, forced valve-opening control is performed with all of the indoor expansion valves 41*a*, 41*b*, 41*c* sensed as being closed.

First, in step ST1, the controller 8 determines whether or not the opening degrees MVa, MVb, MVc of the indoor expansion valves 41*a*, 41*b*, 41*c* during degree of superheating control are smaller than open-valve-ensured opening degrees MVoa, MVob, MVoc. In this embodiment, the open-valve-ensured opening degrees MVoa, MVob, MVoc are opening degrees at which refrigerant flow is ensured to be achieved, even taking into account the individual differences between the opening degrees MVa, MVb, MVc of the indoor expansion valves 41*a*, 41*b*, 41*c*. When the opening degrees MVa, MVb, MVc of the indoor expansion valves 41*a*, 41*b*, 41*c* during degree of superheating control are determined in step ST1 to be smaller than the open-valve-ensured opening degrees MVoa, MVob, MVoc, the sequence transitions to the process of step ST2 on the premise that the indoor expansion valves 41*a*, 41*b*, 41*c* may possibly to reach the fully closed state. When the opening degrees MVa, MVb, MVc of the indoor expansion valves 41*a*, 41*b*, 41*c* during degree of superheating control are not determined in step ST1 to be smaller than the open-valve-ensured opening degrees MVoa, MVob, Mvoc (i.e., when degree of superheating control is determined to be performed in an opening degree range equal to or greater than the open-valve-ensured opening degrees MVoa, MVob, MVoc), there is no possibility that the indoor expansion valves 41*a*, 41*b*, 41*c* may reach the fully closed state, there is no need to perform the processes of step ST2 onward, and the sequence therefore returns to the process of step ST1.

Next, in step ST2, the controller 8 determines whether or not the degrees of superheating SHra, SHrb, SHrc of the refrigerant in the outlets of the indoor heat exchangers 42*a*, 42*b*, 42*c* during degree of superheating control are positive values (i.e., greater than zero). In this embodiment, when the refrigerant degrees of superheating SHra, SHrb, SHrc are zero (or a negative value) and the refrigerant in the outlets of the indoor heat exchangers 42*a*, 42*b*, 42*c* is in a wet state, there is a risk that the compressor 21 will draw in liquid refrigerant. In such cases, even if there is no possibility that the indoor expansion valves may reach the fully closed state, increasing the opening degrees MVa, MVb, MVc of the indoor expansion valves 41*a*, 41*b*, 41*c* through the forced valve-opening control of step ST4 described hereinafter carries the risk of the compressor 21 excessively drawing in liquid refrigerant and is not preferred. Therefore, when the degrees of superheating SHra, SHrb, SHrc of the refrigerant in the outlets of the indoor heat exchangers 42*a*, 42*b*, 42*c* during degree of superheating control are determined in step ST2 to be positive values, the sequence transitions to the process of step ST3 on the premise that it is possible to perform the forced valve-opening control of step ST4 described hereinafter. When the degrees of superheating SHra, SHrb, SHrc of the refrigerant in the outlets of the indoor heat exchangers 42*a*, 42*b*, 42*c* during degree of superheating control are not determined in step ST2 to be positive values, the refrigerant in the outlets of the indoor heat exchangers 42*a*, 42*b*, 42*c* is in a wet state, there is a risk of the compressor 21 excessively drawing in liquid refrigerant, the processes of step ST3 onward should not be performed, and the sequence therefore returns to step ST1.

Next, in step ST3, the controller 8 determines whether or not the two sets of refrigerant temperatures Trla, Trlb, Trlc, Trga, Trgb, Trgc detected by the liquid-side temperature sensors 45*a*, 45*b*, 45*c* and the gas-side temperature sensors 46*a*, 46*b*, 46*c* satisfy a predetermined closed-valve condition in relation to the refrigerant evaporation temperature Te obtained by converting the refrigerant pressure Ps detected by the intake pressure sensor 29 to a saturation temperature of the refrigerant and the indoor temperatures Tra, Trb, Trc detected by the indoor temperature sensors 47*a*, 47*b*, 47*c*.

In this embodiment, the closed-valve condition is set on the basis of ideas such as the following. First, the refrigerant evaporation temperature Te obtained by converting the refrigerant pressure Ps detected by the intake pressure sensor 29 indicates the accurate evaporation temperature even if the indoor expansion valves 41*a*, 41*b*, 41*c* have reached the fully closed state and refrigerant has ceased to flow to the indoor heat exchangers 42*a*, 42*b*, 42*c*, unlike the refrigerant temperatures Trla, Trlb, Trlc in the inlets or the intermediate parts of the indoor heat exchangers 42*a*, 42*b*, 42*c*. When the indoor expansion valves 41*a*, 41*b*, 41*c* are open during degree of superheating control, the refrigerant temperatures Trla, Trlb, Trlc in the inlets or the intermediate parts of the indoor heat exchangers 42*a*, 42*b*, 42*c* indicate temperatures near the refrigerant evaporation temperature Te, and when the indoor expansion valves 41*a*, 41*b*, 41*c* have reached the fully closed state, a state arises in which the refrigerant temperatures Trla, Trlb, Trlc in the inlets or the intermediate parts of the indoor heat exchangers 42*a*, 42*b*, 42*c* deviate from the refrigerant evaporation temperature Te, and the refrigerant temperatures Trla, Trlb, Trlc in the inlets or the intermediate parts of the indoor heat exchangers 42*a*, 42*b*, 42*c*, as well as the refrigerant temperatures Trga, Trgb, Trgc in the outlets of the indoor heat exchangers 42*a*, 42*b*, 42*c*, rise so as to approach the air temperatures Tra, Trb, Trc.

Therefore, in step ST3, when the two sets of refrigerant temperatures Trla, Trlb, Trlc, Trga, Trgb, Trgc during degree of superheating control are lower than first threshold temperatures Tla, Tlb, Tlc (in this embodiment, the same as the air temperatures Tra, Trb, Trc) which are set on the basis of the air temperatures Tra, Trb, Trc detected by the indoor temperature sensors 47*a*, 47*b*, 47*c*, and higher than a second threshold temperature T2 (in this embodiment, Te+α) which is set on the basis of the refrigerant evaporation temperature Te obtained by converting the refrigerant pressure Ps detected by the intake pressure sensor 29 to a refrigerant saturation temperature, the first closed-valve condition is satisfied, in which case the indoor expansion valves 41*a*, 41*b*, 41*c* are determined to be in the fully closed state (closed-valve sensing). In this embodiment, α is set to a comparatively large temperature value (e.g., 5° C. or greater) from the standpoint of preventing erroneous sensing.

In step ST3, when the two sets of refrigerant temperatures Trla, Trlb, Trlc, Trga, Trgb, Trgc during degree of superheating control are determined to be lower than the first threshold temperatures Tla, Tlb, Tlc (=air temperatures Tra, Trb, Trc) set on the basis of the air temperatures Tra, Trb, Trc and higher than the second threshold temperature T2 (=Te+α) set on the basis of the refrigerant evaporation temperature Te obtained by converting the refrigerant pressure Ps detected by the intake pressure sensor 29 to a refrigerant saturation temperature, the sequence transitions to the process of step ST4 on the premise that the indoor expansion valves 41*a*, 41*b*, 41*c* have reached the fully closed state (closed-valve sensing).

In step ST4, the controller 8 performs forced valve-opening control to increase the opening degrees MVa, MVb, MVc of the indoor expansion valves 41*a*, 41*b*, 41*c*. In this embodiment, the opening degrees MVa, MVb, MVc of the indoor expansion valves 41*a*, 41*b*, 41*c* are forcibly opened to the open-valve-ensured opening degrees MVoa, MVob, MVoc in order to enable refrigerant flow to be reliably achieved. The technique of increasing the opening degrees is not limited to this example, and the opening degrees may be opened gradually until they reach the open-valve-ensured opening degrees MVoa, MVob, MVoc. The indoor expansion valves 41*a*, 41*b*, 41*c* during degree of superheating control, which had been in the fully closed state, are thereby forcibly opened, and the fully closed state can be avoided.

Thus, in this embodiment, two sets of refrigerant temperatures are used as the closed-valve condition for the indoor expansion valves 41*a*, 41*b*, 41*c*, including not only the refrigerant temperatures Trla, Trlb, Trlc in the inlets or the intermediate parts of the indoor heat exchangers 42*a*, 42*b*, 42*c*, but also the refrigerant temperatures Trga, Trgb, Trgc in the outlets of the indoor heat exchangers 42*a*, 42*b*, 42*c*; also used are values based on the air temperatures Tra, Trb, Trc serving as ambient temperatures and the refrigerant evaporation temperature Te obtained by converting the refrigerant pressure Ps detected by the intake pressure sensor 29 to a refrigerant saturation temperature. It is thereby possible in this embodiment to perform closed-valve sensing on the indoor expansion valves 41*a*, 41*b*, 41*c* with precision.

When the two sets of refrigerant temperatures Trla, Trlb, Trlc, Trga, Trgb, Trgc during degree of superheating control are not determined in step ST3 to be lower than the first threshold temperatures Tla, Tlb, Tlc (=air temperatures Tra, Trb, Trc) set on the basis of the air temperatures Tra, Trb, Trc and higher than the second threshold temperature T2 (=Te+α) set on the basis of the refrigerant evaporation temperature Te obtained by converting the refrigerant pressure Ps detected by the intake pressure sensor 29 to a refrigerant saturation temperature, the sequence transitions to the process of step ST5 on the premise that the indoor expansion valves 41*a*, 41*b*, 41*c* have not reached the fully closed state (i.e., the valves are in an open state).

In step ST5, the controller 8 determines whether or not the two sets of refrigerant temperatures Trla, Trlb, Trlc, Trga, Trgb, Trgc during degree of superheating control satisfy the second closed-valve condition. When the second closed-valve condition is determined to be satisfied, the sequence transitions to the process of step ST4 and forced valve-opening control is performed, and when the second closed-valve condition is determined to not be satisfied, the sequence returns to the process of step ST1 on the premise that the indoor expansion valves 41*a*, 41*b*, 41*c* are not in the fully closed state.

In this embodiment, the second closed-valve condition is set on the basis of an idea such as the following. In an operating state in which the refrigerant evaporation temperature Te is high, even if the indoor expansion valves 41*a*, 41*b*, 41*c* have reached the fully closed state, there is not likely to be a clearly manifested state in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te, and the condition "higher than the second threshold temperature T2" within the first closed-valve condition described above is not likely to be satisfied. This is because in an operating state in which the refrigerant evaporation temperature Te is high, even if the indoor expansion valves 41*a*, 41*b*, 41*c* are in an open state, the refrigerant evaporation temperature Te and the refrigerant temperatures Trla, Trlb, Trlc in the inlets or the intermediate parts of the indoor heat exchangers 42*a*, 42*b*, 42*c* are close to the air temperatures Tra, Trb, Trc. Therefore, it is preferable to mitigate the value of the threshold temperature for determining whether or not a state manifests in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te, so that it is possible to also adapt to such an operating state in which the refrigerant evaporation temperature Te is high.

In view of this, in step ST5, when the two sets of refrigerant temperatures Trla, Trlb, Trlc, Trga, Trgb, Trgc during degree of superheating control are lower than the first threshold temperatures Tla, Tlb, Tlc (in this embodiment, equal to the air temperatures Tra, Trb, Trc) set on the basis of the air temperatures Tra, Trb, Trc detected by the indoor temperature sensors 47*a*, 47*b*, 47*c* and are higher than third threshold temperatures T3*a*, T3*b*, T3*c* (in this embodiment, equal to average values of the air temperatures Tra, Trb, Trc and the evaporation temperature Te) set on the basis of average values (Tra+Te)/2, (Trb+Tc)/2, (Trc+Te)/2 of the air temperatures Tra, Trb, Trc detected by the indoor temperature sensors 47*a*, 47*b*, 47*c* and the refrigerant evaporation temperature Te obtained by converting the refrigerant pressure Ps detected by the intake pressure sensor 29 to a refrigerant saturation temperature, the second closed-valve condition is satisfied, in which case the indoor expansion valves 41*a*, 41*b*, 41*c* are determined to be in the fully closed state (closed-valve sensing).

It is thereby possible in this embodiment to perform closed-valve sensing on the indoor expansion valves 41*a*, 41*b*, 41*c* even in an operating state in which the refrigerant evaporation temperature Te is high.

(4) Characteristics of Air Conditioning Apparatus

The air conditioning apparatus 1 has characteristics such as the following.

<A>

In this embodiment, as described above, the indoor expansion valves 41*a*, 41*b*, 41*c* are determined to be in the fully closed state (closed-valve sensing) when the two sets of refrigerant temperatures Trla, Trlb, Trlc, Trga, Trgb, Trgc detected by the liquid-side temperature sensors 45*a*, 45*b*, 45*c* and the gas-side temperature sensors 46*a*, 46*b*, 46*c* satisfy a predetermined closed-valve condition in relation to the refrigerant evaporation temperature Te obtained by converting the refrigerant pressure Ps in the intake side of the compressor 21 as detected by the intake pressure sensor 29 to a refrigerant saturation temperature and the air temperatures Tra, Trb, Trc of air-conditioned spaces cooled by the indoor heat exchangers 42*a*, 42*b*, 42*c*, the air temperatures Tra, Trb, Trc being detected by the indoor temperature sensors 47*a*, 47*b*, 47*c*. Specifically, in this embodiment, unlike Patent Literature 1, two sets of refrigerant temperatures are used as the closed-valve condition for the indoor expansion valves 41*a*, 41*b*, 41*c*, including not only the refrigerant temperatures Trla, Trlb, Trlc in the inlets or the intermediate parts of the indoor heat exchangers 42*a*, 42*b*, 42*c*, but also the refrigerant temperatures Trga, Trgb, Trgc in the outlets of the indoor heat exchangers 42*a*, 42*b*, 42*c*; also used are values based on the air temperatures Tra, Trb, Trc serving as ambient temperatures and the refrigerant evaporation temperature Te obtained by converting the refrigerant pressure Ps detected by the intake pressure sensor 29. In this embodiment, the refrigerant evaporation temperature Te obtained by converting the refrigerant pressure Ps detected by the intake pressure sensor 29 indicates the accurate evaporation temperature even if the indoor expansion valves 41*a*, 41*b*, 41*c* have reached the fully closed state and refrigerant has ceased to flow to the indoor heat exchangers 42*a*, 42*b*, 42*c*, unlike the refrigerant temperatures Trla, Trlb, Trlc in the inlets or the intermediate parts of the indoor heat exchangers 42*a*, 42*b*, 42*c*.

It is thereby possible in this embodiment to perform closed-valve sensing on the indoor expansion valves 41*a*, 41*b*, 41*c* with greater precision than in the case of Patent Literature 1, in which the value used as the closed-valve condition is the temperature change when the expansion valve has reached the fully closed state and the temperature of the refrigerant in the outlet of the expansion valve rises due to the effect of the ambient temperature.

<B>

In a case in which the opening degrees of the indoor expansion valves 41*a*, 41*b*, 41*c* are controlled so that the degrees of superheating SHra, SHrb, SHrc of the refrigerant reach the target degrees of superheating SHras, SHrbs, SHrcs, the refrigerant temperatures Trla, Trlb, Trlc in the inlets or the intermediate parts of the indoor heat exchangers 42*a*, 42*b*, 42*c* indicate temperatures near the refrigerant evaporation temperature Te when the indoor expansion valves 41*a*, 41*b*, 41*c* are in an open state, and when the indoor expansion valves 41*a*, 41*b*, 41*c* reach the fully closed state, a state manifests in which the refrigerant temperatures Trla, Trlb, Trlc in the inlets or the intermediate parts of the indoor heat exchangers 42*a*, 42*b*, 42*c* deviate from the refrigerant evaporation temperature Te, and the refrigerant temperatures Trla, Trlb, Trlc in the inlets or the intermediate parts of the indoor heat exchangers 42*a*, 42*b*, 42*c* and the refrigerant temperatures Trga, Trgb, Trgc in the outlets of the indoor heat exchangers 42*a*, 42*b*, 42*c* rise so as to approach the air temperatures Tra, Trb, Trc.

In view of this, in this embodiment, such a state of the two sets of refrigerant temperatures Trla, Trlb, Trlc, Trga, Trgb, Trgc is sensed by determining whether or not the two sets of refrigerant temperatures Trla, Trlb, Trlc, Trga, Trgb, Trgc satisfy the first closed-valve condition, as described above. Therefore, in this embodiment, closed-valve sensing for the indoor expansion valves 41*a*, 41*b*, 41*c* can be performed with precision.

<C>

In this embodiment, in an operating state in which the refrigerant evaporation temperature Te is high, even if the indoor expansion valves 41*a*, 41*b*, 41*c* reach the fully closed state, there is not likely to be a clear state in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te, and the condition "higher than the second threshold temperature T2" within the first closed-valve condition described above is not likely to be satisfied. This is because in an operating state in which the refrigerant evaporation temperature Te is high, even if the indoor expansion valves 41*a*, 41*b*, 41*c* are in an open state, the refrigerant evaporation temperature Te and the refrigerant temperatures Trla, Trlb, Trlc in the inlets or the intermediate parts of the indoor heat exchangers 42*a*, 42*b*, 42*c* are close to the air temperatures Tra, Trb, Trc. Therefore, it is preferable to mitigate the value of the threshold temperature for determining whether or not a state manifests in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te, so that it is possible to also adapt to such an operating state in which the refrigerant evaporation temperature Te is high.

In view of this, in this embodiment, the second closed-valve condition is added, which is that the closed-valve condition is satisfied also when the two sets of refrigerant temperatures Trla, Trlb, Trlc, Trga, Trgb, Trgc are higher than the third threshold temperatures set on the basis of the average value of the air temperatures detected by the indoor temperature sensors 47*a*, 47*b*, 47*c* and the refrigerant evaporation temperature Te obtained by converting the refrigerant pressure Ps detected by the intake pressure sensor 29 to a refrigerant saturation temperature, as described above. Therefore, in this embodiment, closed-valve sensing for the indoor expansion valves 41*a*, 41*b*, 41*c* can be performed even in an operating state in which the refrigerant evaporation temperature Te is high.

<D>

In a case in which the capacity of the compressor 21 is controlled so that the refrigerant pressure Ps (Pe) in the intake side of the compressor 21 or the evaporation temperature Te obtained by converting this refrigerant pressure reaches a target value (the target low pressure Pes or the target evaporation temperature Tes), the refrigerant temperatures Trla, Trlb, Trlc in the inlets or the intermediate parts of the indoor heat exchangers 42*a*, 42*b*, 42*c* and the refrigerant evaporation temperature Te come to be near the air temperatures Tra, Trb, Trc when the target low pressure Pes or the target evaporation temperature Tes is set high in order to reduce the capacity of the compressor 21, even if the indoor expansion valves 41*a*, 41*b*, 41*c* are in an open state. Therefore, when the closed-valve condition includes only the first closed-valve condition, there is not likely to be a clear state in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te, and the condition "higher than the second threshold temperature T2" is not likely to be satisfied, even if the indoor expansion valves 41*a*, 41*b*, 41*c* reach the fully closed state. When the target low pressure Pes or the target evaporation temperature Tes is set low in order to increase the capacity of the compressor 21, there is likely to be a clear state in which the refrigerant temperatures Trla, Trlb, Trlc in the inlets or the intermediate parts of the indoor heat exchangers 42*a*, 42*b*, 42*c* rise so as to deviate from the refrigerant evaporation temperature Te when the indoor expansion valves 41*a*, 41*b*, 41*c* reach the fully closed state. Regardless of this, when the closed-valve condition includes only the second closed-valve condition, a situation could occur in which the refrigerant temperatures Trla, Trlb, Trlc in the inlets or the intermediate parts of the indoor heat exchangers 42*a*, 42*b*, 42*c* do not satisfy the closed-valve condition when the refrigerant temperatures Trla, Trlb, Trlc in the inlets or the intermediate parts of the indoor heat exchangers 42*a*, 42*b*, 42*c* do not significantly rise even though the indoor expansion valves 41*a*, 41*b*, 41*c* have reached the fully closed state, because the third threshold temperatures T3*a*, T3*b*, T3*c* set on the basis of the average values of the air temperatures Tra, Trb, Trc and the refrigerant evaporation temperature Te are set to higher temperatures than the refrigerant evaporation temperature Te. Thus, when capacity control for the compressor 21 is performed, there are cases in which it is difficult to perform closed-valve sensing for the indoor expansion valves 41*a*, 41*b*, 41*c*.

However, in this embodiment, because the closed-valve condition includes both the first closed-valve condition and the second closed-valve condition as described above, closed-valve sensing for the indoor expansion valves 41*a*, 41*b*, 41*c* can be performed while capacity control for the compressor 21 is performed.

<E>

Should the air conditioning apparatus be in an operating state in which the degrees of superheating SHra, SHrb, SHrc of the refrigerant were zero (or a negative value) and the refrigerant in the outlets of the indoor heat exchangers 42*a*, 42*b*, 42*c* was in a wet state, the opening degrees MVa, MVb, MVc of the indoor expansion valves 41*a*, 41*b*, 41*c* would regardless increase when the above-described closed-valve condition relying on the two sets of refrigerant temperatures Trla, Trlb, Trlc, Trga, Trgb, Trgc, the refrigerant evaporation temperature Te, and the air temperatures Tra, Trb, Trc is satisfied and forced valve-opening control is performed; therefore, there would be a risk that the refrigerant in the outlets of the indoor heat exchangers 42*a*, 42*b*, 42*c* would reach a wet state having an even greater degree of wetness and the compressor 21 would excessively draw in liquid refrigerant.

In view of this, in this embodiment, the condition that the degrees of superheating SHra, SHrb, SHrc of the refrigerant are a positive value is added to the closed-valve condition, ensuring either that the refrigerant in the outlets of the indoor heat exchangers 42*a*, 42*b*, 42*c* does not reach a wet state or that the compressor 21 does not excessively draw in liquid refrigerant even when the closed-valve condition is satisfied and forced valve-opening control is performed, as described above. Therefore, in this embodiment, closed-valve sensing for the indoor expansion valves 41*a*, 41*b*, 41*c* can be performed while ensuring that the compressor 21 does not excessively draw in liquid refrigerant even if forced valve-opening control is performed.

<F>

When the opening degrees MVa, MVb, MVc of the indoor expansion valves 41*a*, 41*b*, 41*c* are controlled so that the degrees of superheating SHra, SHrb, SHrc of the refrigerant reach the target degrees of superheating SHras, SHrbs, SHrcs in an opening degree range equal to or greater than the open-valve-ensured opening degrees MVoa, MVob, MVoc, at which refrigerant flow is ensured to be achieved even taking into account individual differences in the indoor expansion valves 41*a*, 41*b*, 41*c*, the indoor expansion valves 41*a*, 41*b*, 41*c* do not reach the fully closed state and there is no need to perform closed-valve sensing such as is described above.

In view of this, in this embodiment, the condition that the opening degrees MVa, MVb, MVc of the indoor expansion valves 41*a*, 41*b*, 41*c* are smaller than the open-valve-ensured opening degrees MVoa, MVob, MVoc is added to the closed-valve condition, and closed-valve sensing is performed only when the opening degrees MVa, MVb, MVc of the indoor expansion valves 41*a*, 41*b*, 41*c* are smaller than the open-valve-ensured opening degrees MVoa, MVob, MVoc, as described above. Therefore, in this embodiment, closed-valve sensing can be performed appropriately only in cases in which there is a risk that the indoor expansion valves 41*a*, 41*b*, 41*c* will reach the fully closed state.

(5) Modifications

In the embodiment described above, closed-valve sensing and forced valve-opening control are applied to an air conditioning apparatus that can switch between an air-cooling operation and an air-warming operation, but this arrangement is not provided by way of limitation; closed-valve sensing and forced valve-opening control may also be applied to, e.g., an air conditioning apparatus configured only for an air-cooling operation.

Additionally, in the embodiment described above, forced valve-opening control is performed for expansion valves determined by closed-valve sensing to be in the fully closed state, but this arrangement is not provided by way of limitation, and another option is, e.g., to give notification of an abnormality stating that a valve is in a fully closed state without performing forced valve-opening control.

INDUSTRIAL APPLICABILITY

The present invention is widely applicable to air conditioning apparatuses that have a refrigerant circuit configured by connecting a compressor, an outdoor heat exchanger, an expansion valve, and an indoor heat exchanger, and that perform an air-cooling operation in which refrigerant is circulated sequentially through the compressor, the outdoor heat exchanger, the expansion valve, and the indoor heat exchanger.

What is claimed is:

1. An air conditioning apparatus comprising:

a refrigerant circuit including a compressor, an outdoor heat exchanger, an expansion valve, and an indoor heat exchanger connected together with the compressor, the outdoor heat exchanger and the expansion valve, the air conditioning apparatus performing an air-cooling operation in which refrigerant is circulated sequentially through the compressor, the outdoor heat exchanger, the expansion valve, and the indoor heat exchanger;

a liquid-side temperature sensor arranged to detect a refrigerant temperature in an inlet or an intermediate part of the indoor heat exchanger;

a gas-side temperature sensor arranged to to detect a refrigerant temperature in an outlet of the indoor heat exchanger, the liquid-side and gas-side temperature sensors being provided in a section of the refrigerant circuit that extends from an outlet of the expansion valve to the outlet of the indoor heat exchanger;

an intake pressure sensor arranged to detect refrigerant pressure in an intake side of the compressor;

an indoor temperature sensor arranged to detect air temperature in an air-conditioned space cooled by the indoor heat exchanger; and a controller to control the compressor and the expansion valve during the air-cooling operation, the controller controlling an opening degree of the expansion valve during the air-cooling operation so that a degree of superheating of the refrigerant, obtained by subtracting the refrigerant temperature detected by the liquid-side temperature sensor from the temperature of the refrigerant detected by the gas-side temperature sensor, reaches a target degree of superheating, and that the expansion valve is in a fully closed state when the refrigerant temperatures detected by the liquid-side temperature sensor and the gas-side temperature sensor satisfy a predetermined closed-valve condition in relation to an evaporation temperature of the refrigerant obtained by converting the refrigerant pressure detected by the intake pressure sensor to a saturation temperature of the refrigerant, and in relation to the air temperature detected by the indoor temperature sensor, the predetermined closed-valve condition including a first closed-valve condition, which is that the refrigerant temperatures detected by the liquid-side temperature sensor and the gas-side temperature sensor are lower than a first threshold temperature based on the air temperature detected by the indoor temperature sensor, and higher than a second threshold temperature based on the refrigerant evaporation temperature obtained by converting the refrigerant pressure detected by the intake pressure sensor to a refrigerant saturation temperature.

2. The air conditioning apparatus according to claim 1, wherein the predetermined closed-valve condition further includes a second closed-valve condition, which is that the refrigerant temperatures detected by the liquid-side temperature sensor and the gas-side temperature sensor are lower than the first threshold temperature based on the air temperature detected by the indoor temperature sensor, and higher than a third threshold temperature based on the average value of the air temperature detected by the indoor temperature sensor and the refrigerant evaporation temperature obtained by converting the refrigerant pressure detected by the intake pressure sensor to a refrigerant saturation temperature, and the predetermined closed-valve condition is satisfied when the first closed-valve condition or the second closed-valve condition is satisfied.

3. The air conditioning apparatus according to claim 2, wherein the controller controls a capacity of the compressor during the air-cooling operation so that either the refrigerant pressure detected by the intake pressure sensor reaches a target low pressure, or the refrigerant evaporation temperature obtained by converting the refrigerant pressure detected by the intake pressure sensor to a refrigerant saturation temperature reaches a target evaporation temperature.

4. An air conditioning apparatus comprising:

a refrigerant circuit including a compressor, an outdoor heat exchanger, an expansion valve, and an indoor heat exchanger connected together with the compressor, the outdoor heat exchanger and the expansion valve, the air conditioning apparatus performing an air-cooling operation in which refrigerant is circulated sequentially through the compressor, the outdoor heat exchanger, the expansion valve, and the indoor heat exchanger;

a liquid-side temperature sensor arranged to detect a refrigerant temperature in an inlet or an intermediate part of the indoor heat exchanger;

a gas-side temperature sensor arranged to to detect a refrigerant temperature in an outlet of the indoor heat exchanger, the liquid-side and gas-side temperature sensors being provided in a section of the refrigerant circuit that extends from an outlet of the expansion valve to the outlet of the indoor heat exchanger;

an intake pressure sensor arranged to detect refrigerant pressure in an intake side of the compressor;

an indoor temperature sensor arranged to detect air temperature in an air-conditioned space cooled by the indoor heat exchanger; and a controller to control the compressor and the expansion valve during the air-cooling operation, the controller controlling an opening degree of the expansion valve during the air-cooling operation so that a degree of superheating of the refrigerant, obtained by subtracting the refrigerant temperature detected by the liquid-side temperature sensor from the temperature of the refrigerant detected by the gas-side temperature sensor, reaches a target degree of superheating, and that the expansion valve is in a fully closed state when the refrigerant temperatures detected by the liquid-side temperature sensor and the gas-side temperature sensor satisfy a predetermined closed-valve condition in relation to an evaporation temperature of the refrigerant obtained by converting the refrigerant pressure detected by the intake pressure sensor to a saturation temperature of the refrigerant, and in relation to the air temperature detected by the indoor temperature sensor, the predetermined closed-valve condition including a condition that the degree of superheating of the refrigerant is a positive value.

5. The air conditioning apparatus according to claim 1, wherein the predetermined closed-valve condition includes a condition that the opening degree of the expansion valve is smaller than an open-valve-ensured opening degree at which refrigerant flow is ensured to be achieved.

6. The air conditioning apparatus according to claim 1, wherein the controller performs a forced valve-opening control to increase the opening degree of the expansion valve when the expansion valve is determined to be in the fully closed state.

7. The air conditioning apparatus according to claim 1, wherein the predetermined closed-valve condition includes a condition that the degree of superheating of the refrigerant is a positive value.

8. The air conditioning apparatus according to claim 1, wherein the predetermined closed-valve condition includes a condition that the opening degree of the expansion valve is smaller than an open-valve-ensured opening degree at which refrigerant flow is ensured to be achieved.

9. The air conditioning apparatus according to claim 2, wherein the predetermined closed-valve condition includes a condition that the degree of superheating of the refrigerant is a positive value.

10. The air conditioning apparatus according to claim 2, wherein the predetermined closed-valve condition includes a condition that the opening degree of the expansion valve is smaller than an open-valve-ensured opening degree at which refrigerant flow is ensured to be achieved.

11. The air conditioning apparatus according to claim 3, wherein the predetermined closed-valve condition includes a condition that the degree of superheating of the refrigerant is a positive value.

12. The air conditioning apparatus according to claim 3, wherein the predetermined closed-valve condition includes a condition that the opening degree of the expansion valve is smaller than an open-valve-ensured opening degree at which refrigerant flow is ensured to be achieved.

13. The air conditioning apparatus according to claim 4, wherein the predetermined closed-valve condition includes a condition that the opening degree of the expansion valve is smaller than an open-valve-ensured opening degree at which refrigerant flow is ensured to be achieved.

14. The air conditioning apparatus according to claim 4, wherein the controller performs a forced valve-opening control to increase the opening degree of the expansion valve when the expansion valve is determined to be in the fully closed state.

15. The air conditioning apparatus according to claim 5, wherein the controller performs a forced valve-opening control to increase the opening degree of the expansion valve when the expansion valve is determined to be in the fully closed state.

* * * * *